US011509031B2

(12) United States Patent
Zhou et al.

(10) Patent No.: US 11,509,031 B2
(45) Date of Patent: Nov. 22, 2022

(54) SUBSTRATE-INTEGRATED WAVEGUIDE FILTERING CROSSOVER HAVING A DUAL MODE RECTANGULAR CAVITY COUPLED TO EIGHT SINGLE MODE SQUARE CAVITIES

(71) Applicants: Kang Zhou, Montreal (CA); Ke Wu, Montreal (CA)

(72) Inventors: Kang Zhou, Montreal (CA); Ke Wu, Montreal (CA)

(73) Assignee: HUAWEI TECHNOLOGIES CANADA CO., LTD., Kanata (CA)

( * ) Notice: Subject to any disclaimer, the term of this patent is extended or adjusted under 35 U.S.C. 154(b) by 0 days.

(21) Appl. No.: 17/144,883

(22) Filed: Jan. 8, 2021

(65) Prior Publication Data

US 2022/0223990 A1 Jul. 14, 2022

(51) Int. Cl.

| | |
|---|---|
| ***H01P 1/208*** | (2006.01) |
| ***H01P 1/213*** | (2006.01) |
| ***H01P 1/212*** | (2006.01) |
| ***H01P 3/00*** | (2006.01) |

(52) U.S. Cl.

CPC ..... *H01P 1/2082* (2013.01); *H01P 1/2088* (2013.01); *H01P 1/212* (2013.01); *H01P 1/2135* (2013.01); *H01P 3/006* (2013.01)

(58) Field of Classification Search

CPC .... H01P 1/2002; H01P 1/2088; H01P 1/2082; H01P 3/121; H01P 1/2138

USPC ..... 333/208, 134

See application file for complete search history.

(56) References Cited

PUBLICATIONS

T.-S. Horng, "A rigorous study of microstrip crossovers and their possible improvements," IEEE Trans. Microw. Theory Techn., vol. 42, No. 9, pp. 1802-1806, Sep. 1994.

Y. Chen and S.-P. Yeo, "A symmetrical four-port microstrip coupler for crossover application," IEEE Trans. Microw. Theory Techn., vol. 55, No. 11, pp. 2434-2438, Nov. 2007.

J. Yao, C. Lee, and S. P. Yeo, "Microstrip branch-line couplers for crossover application," IEEE Trans. Microw. Theory Techn., vol. 59, No. 1, pp. 87-92, Jan. 2011.

F.-L. Wong and K.-K. M. Cheng, "A novel, planar, and compact crossover design for dual-band applications," IEEE Trans. Microw. Theory Techn., vol. 59, No. 3, pp. 568-573, Mar. 2011.

W. Liu, Z. Zhang, Z. Feng, and M. F. Iskander, "A compact wideband microstrip crossover," IEEE Microw. Wireless Compon. Lett., vol. 22, No. 5, pp. 254-256, May 2012.

J. Shao, H. Ren, B. Arigong, C. Li, and H. Zhang, "A fully symmetrical crossover and its dual-frequency application," IEEE Trans. Microw. Theory Techn., vol. 60, No. 8, pp. 2410-2416, Aug. 2012.

(Continued)

*Primary Examiner* — Benny T Lee

(57) ABSTRACT

Various substrate-integrated waveguide (SIW) filtering crossover systems are described. An example SIW filtering crossover system may include: a substrate; a top metal plate placed on top of the substrate; a bottom metal plate placed beneath the substrate; a plurality of metalized via-holes in the substrate connecting the top metal plate and the bottom metal plate; and a plurality of grounded-coplanar-waveguides (GCPWs) coupled to sidewalls of the crossover system, wherein each of the GCPWs connects the crossover system to a respective microstrip line for signal transmission between the respective microstrip line and the crossover system.

13 Claims, 25 Drawing Sheets

(56) References Cited

PUBLICATIONS

A. Abbosh, S. Ibrahim, and M. Karim, "Ultra-wideband crossover using microstrip-to-coplanar waveguide transitions," IEEE Microw. Wireless Compon. Lett., vol. 22, No. 10, pp. 500-502, Oct. 2012.
F. Lin, Q.-X. Chu, and S. W. Wong, "Dual-band planar crossover with two-section branch-line structure," IEEE Trans. Microw. Theory Techn., vol. 61, No. 6, pp. 2309-2316, Jun. 2013.
Y. Wang, A. M. Abbosh, and B. Henin, "Broadband microwave crossover using combination of ring resonator and circular microstrip patch," IEEE Trans. Compon., Packag., Manuf. Technol., vol. 3, No. 10, pp. 1771-1777, Oct. 2013.
X. Y. Zhang, Q.-Y. Guo, K.-X. Wang, B.-J. Hu, and H. L. Zhang, "Compact filtering crossover using stub-loaded ring resonator," IEEE Microw. Wireless Compon. Lett., vol. 24, No. 5, pp. 327-329, May 2014.
C.-W. Tang, K.-C. Lin, and W.-C. Chen, "Analysis and design of compact and wide-passband planar crossovers," IEEE Trans. Microw. Theory Techn., vol. 62, No. 12, pp. 2975-2982, Dec. 2014.
M. A. Maktoomi, M. S. Hashmi, and F. M. Ghannouchi, "Systematic design technique for dual-band branch-line coupler using T- and Pi- networks and their application in novel wideband-ratio crossover," IEEE Trans. Compon., Packag., Manuf. Technol., vol. 6, No. 5, pp. 784-795, May 2016.
Q.-Y. Guo, X. Y. Zhang, and L. Gao, "Novel compact planar crossover with bandpass response based on cross-shaped resonator," IEEE Trans. Compon., Packag., Manuf. Technol., vol. 7, No. 12, pp. 2018-2026, Dec. 2017.
P.-C. Chu and C.-W. Tang, "Design of a compact planar crossover with four intersecting channels," IEEE Microw. Wireless Compon. Lett., vol. 28, No. 4, pp. 293-295, Apr. 2018.
Y.-H. Pang and J.-J. Li, "A planar wideband balanced crossover," IEEE Trans. Compon., Packag., Manuf. Technol., vol. 8, No. 10, pp. 1807-1814, Oct. 2018.
H. Ren, M. Zhou, H. Zhang, and B. Arigong, "A novel dual-band zero-phase true crossover with arbitrary port impedance," IEEE Microw. Wireless Compon. Lett., vol. 29, No. 1, pp. 29-31, Jan. 2019.
T. Djerafi, N. J. G. Fonseca, and K. Wu, "Design and implementation of a planar 4×4 Butler matrix in SIW technology for wideband applications", in Proc. 40th Eur. Microwave Conf., Paris, France, Sep. 2010, pp. 910-913.
Y. J. Cheng, P. Chen, W. Hong, T. Djerafi, and K. Wu, "Substrate-integrated-waveguide beamforming networks and multibeam antenna arrays for low-cost satellite and mobile systems," IEEE Antennas Propag. Mag., vol. 53, No. 6, pp. 18-30, Dec. 2011.
Q.-L. Yang, Y.-L. Ban, K. Kang, C.-Y.-D. Sim, and G. Wu, "SIW multibeam array for 5G mobile devices," IEEE Access, vol. 4, pp. 2788-2796, Jun. 2016.
J.-W. Lian, Y.-L. Ban, C. Xiao, and Z.-F. Yu, "Compact substrate-integrated 4×8 Butler matrix with sidelobe suppression for millimeter-wave multibeam application," IEEE Antennas Wireless Propag. Lett., vol. 17, No. 5, pp. 928-932, May 2018.
S. S. Hesari and J. Bornemann, "Frequency-selective substrate integrated waveguide front-end system for tracking applications," IET Microw., Antennas Propag., vol. 12, No. 10, pp. 1620-1624, Aug. 2018.
T. Djerafi and K. Wu, "60 GHz substrate integrated waveguide crossover structure," in Proc. 39th Eur. Microwave Conf., Rome, Italy, Oct. 2009, pp. 1014-1017.
L. Han, K. Wu, X.-P. Chen, and F. He, "Accurate analysis of finite periodic substrate integrated waveguide structures and its applications," in IEEE MTT-S Int. Microw. Symp. Dig., Anaheim, CA, USA, May 2010, pp. 864-867.
A. B. Guntupalli, T. Djerafi, and K.Wu, "Ultra-compact millimeter-wave substrate integrated waveguide crossover structure utilizing simultaneous electric and magnetic coupling," in IEEE MTT-S Int. Microw. Symp. Dig., Montreal, QC, Canada, Jun. 2012, pp. 1-3.
X. F. Ye, S. Y. Zheng, and J. H. Deng, "A compact patch crossover for millimeter-wave applications," in Proc. IEEE Int. Workshop Electromagn. (iWEM), Hsinchu, Taiwan, Nov. 2015, pp. 1-2.
S. Y. Zheng and X. F. Ye, "Ultra-compact wideband millimeter-wave crossover using slotted SIW structure," in Proc. IEEE Int. Workshop Electromagn. (iWEM), Nanjing, China, May 2016, pp. 1-2.
J. Bornemann and S. S. Hesari, "Scattering matrix subtraction technique for mode-matching analysis of substrate integrated waveguide junctions," in Proc. IEEE MTT-S Int. Conf. Numer. Electromagn. Multiphys. Modeling Optim. (NEMO), Seville, Spain, May 2017, pp. 1-3.
M. M. M. Ali and A. Sebak, "Compact printed ridge gap waveguide crossover for future 5G wireless communication system," IEEE Microw. Wireless Compon. Lett., vol. 28, No. 7, pp. 549-551, Jul. 2018.
S.-Q. Han, K. Zhou, J.-D. Zhang, C.-X. Zhou, and W. Wu, "Novel substrate integrated waveguide filtering crossover using orthogonal degenerate modes," IEEE Microw. Wireless Compon. Lett., vol. 27, No. 9, pp. 803-805, Sep. 2017.
S. S. Hesari and J. Bornemann, "Substrate integrated waveguide crossover formed by orthogonal TE102 resonators," in Proc. 47th Eur. Microw. Conf., Nuremberg, Germany, Oct. 2017, pp. 17-20.
Y. Zhou, K. Zhou, J. Zhang, C. Zhou, and W. Wu, "Miniaturized substrate integrated waveguide filtering crossover," in Proc. IEEE Elect. Design Adv. Packag. Syst. Symp. (EDAPS), Haining, China, Dec. 2017, pp. 1-3.
Y. Zhou, K. Zhou, J. Zhang, and W. Wu, "Substrate-integrated waveguide filtering crossovers with improved selectivity," Int. J. RF Microw. Comput-Aided Eng.. doi: 10.1002/mmce.22067.
K. Zhou, C.-X. Zhou, and W. Wu, "Substrate-integrated waveguide dual-band filters with closely spaced passbands and flexibly allocated bandwidths," IEEE Trans. Compon., Packag., Manuf. Technol., vol. 8, No. 3, pp. 465-472, Mar. 2018.
J.-S. Hong and M. J. Lancaster, Microstrip Filters for RF/Microwave Applications. New York, NY, USA: Wiley, 2001, chs. 8-10.
K. Zhou, C.-X. Zhou, and W. Wu, "Resonance characteristics of substrate-integrated rectangular cavity and their applications to dual-band and wide-stopband bandpass filters design," IEEE Trans. Microw. Theory Techn., vol. 65, No. 5, pp. 1511-1524, May 2017.
Zhou, K. Zhou C. and Wu, W., "Compact Planar Substrate-Integrated Waveguide Diplexers with Wide-Stopband Characteristics" Int J RF Microw Comput Aided Eng. 2020;e22179.
Zhou, K., Zhou, C.-X., Wu, W., "Substrate-Integrated Waveguide Dual-Mode Dual-Band Bandpass Filters With Widely Controllable Bandwidth Ratios" IEEE Transactions on Microwave Theory and Techniques, vol. 65, No. 10, Oct. 10, 2017.
K. Zhou et al. "Wide-Stopband Substrate-Integrated Waveguide Filtering Crossovers With Flexibly Allocated Channel Frequencies and Bandwidths," in IEEE Transactions on Microwave Theory and Techniques, vol. 69, No. 7 Jul. 2021.
Y. Zhou, et al. "Miniaturized substrate integrated waveguide filtering crossover," 2017 IEEE Electrical Design of Advanced Packaging and Systems Symposimn (EDAPS). 2017.
Y. Cao et al. "A Compact Millimeter-Wave Planar Directional Coupled Crossover With a Wide Bandwidth," in IEEE Microwave and Wireless Components Letters, vol. 30, No. 7 Jul. 2020.
K. Zhou et al. "Substrate-Integrated Waveguide Dual-Band Filters With Closely Spaced Passbands and flexibly Allocated Bandwidths," in IEEE Transactions on Components, Packaging and Manufacturing Technology, vol. 8, No. 3 Mar. 2018.
K. Zhou et al. "Substrate-Integrated Waveguide Dual-Mode Dual Band Bandpass Filters With Widely Controllable Bandwidth Ratios," in IEEE Transactions on Microwave Theory and Techniques, vol. 65, No. 10 Oct. 2017.
S. Han et al. "Novel substrate integrated waveguide filtering crossover Using Orthogonal Degenerate Modes," in IEEE Microwave and wireless Components Letters, vol. 27, No. 9, Sep. 2017.

SUBSTRATE-INTEGRATED WAVEGUIDE FILTERING CROSSOVER HAVING A DUAL MODE RECTANGULAR CAVITY COUPLED TO EIGHT SINGLE MODE SQUARE CAVITIES

REFERENCE TO RELATED APPLICATIONS

This is the first patent application for the present disclosure.

TECHNICAL FIELD

The present application relates to substrate-integrated waveguide (SIW) devices, and in particular to compact SIW filtering crossover devices and systems.

BACKGROUND

When two or more signals are transmitted in intersecting transmission routes, it is ideal to have them intersecting one another without mutual interferences, or at least, with the least amount of possible inference. Crossovers are important components in modern wireless electronic systems, especially in beamforming networks for multi-beam antenna applications. As a well-known technological platform for microwave and millimeter-wave communications and sensing applications, substrate-integrated waveguide (SIW) technology has provided an effective solution for sophisticated crossovers, thanks to the merits of low-cost, low-loss, high-power handling capability, and high-density integration.

FIG. 1A shows a simplified top view of an example SIW cavity resonator 100, which may simply be referred to as a substrate-integrated rectangular cavity (SIRC). For a SIW transmission line to operate at a given frequency, three main parameters are considered: the effective width of the SIW, $W_{eff}$; the diameter of the metallic post, d; and the distance between the metallic posts, p. The effective width of the SIW $W_{eff}$ governs the cut-off frequencies of the propagation mode of the SIW transmission line. $L_{eff}$ is the effective length of the SIW. The parameters, d and p, determine how well the SIW transmission line mimics a rectangular waveguide.

Generally, SIW refers to a SIW transmission line, while SIRC refers to a SIW rectangular cavity.

For a rectangular SIW, a transverse electric (TE) 10 mode means a waveguide cavity operating on a $TE_{10}$ wave, and the length of the cavity is half of the guide wavelength. Particularly, for rectangular waveguides, the TE10 mode has the lowest cutoff frequency and so called the "dominant mode." Below this cutoff frequency, no signals can propagate along the waveguide. The TE signifies that all electric fields are transverse (perpendicular) to the direction of propagation and that no longitudinal electric field is present. These are sometimes called "H modes" because there is only a magnetic field along the direction of propagation (H is the conventional symbol for magnetic field). For a rectangular SIW, TE20 mode occurs when the effective width of the SIW equals one wavelength of the lowest cutoff frequency.

Resonance characteristics of SIRC, and various modes of SIRC, are discussed in the document K. Zhou, C. Zhou and W. Wu, "*Resonance Characteristics of Substrate-Integrated Rectangular Cavity and Their Applications to Dual-Band and Wide-Stopband Bandpass Filters Design*," in IEEE Transactions on Microwave Theory and Techniques, vol. 65, no. 5, pp. 1511-1524, May 2017, the content of which is herein incorporated by reference in its entirety.

It is to be appreciated that a person skilled in the art generally understands the meaning of $TE_{101}$, $TE_{102}$, $TE_{201}$, and $TE_{202}$ modes in the context of SIW devices and SIW crossover systems.

Some solutions have been reported to implement advanced SIW crossovers. However, the bandwidths (BWs) of these schemes cannot be controlled easily without integration of filtering functions. FIG. 1B shows two example SIW crossover schemes, one in cascaded scheme 120 and another in integrated scheme 150. One example existing solution to realize filtering crossovers is to attach a bandpass filter (i.e. BPFI, BPFII) to each channel of a crossover junction in a cascaded scheme, as shown in apparatus 120 in FIG. 1B. The footprints of circuits with this scheme tend to be considerably large in practice and may increase channel insertion losses (ILs) and design complexities.

To reduce circuit sizes (or footprints) and losses, an alternative approach is devised in which the filtering crossover junction and the two BPFs are designed collaboratively in an integrated scheme, as demonstrated in apparatus 150 in FIG. 1B, based on orthogonal degenerated $TE_{102}$ and $TE_{201}$ modes in SIW square cavities. However, the frequency responses of the two channels are identical for these crossovers due to the full symmetry of the structures.

SUMMARY OF THE INVENTION

The present disclosure describes various SIW filtering crossover systems with flexibly allocated center frequencies (CFs) and BWs for two intersecting channels. The disclosed embodiments can provide flexibly allocated CFs and BWs for two intersecting channels, and wide-stopband characteristics can be achieved without resorting to extra components or distributed elements. The embodiments also can provide improved stopband performances to avoid or reduce interferences of spurious signals from outside or inside the transceivers.

In accordance to some aspect, an example substrate-integrated waveguide (SIW) filtering crossover system may include a dual-mode SIW square cavity and a plurality of coplanar waveguide (CPW) resonators, where each of the plurality of CPW resonators may be coupled to a respective side of the dual-mode SIW square cavity at the center of the respective side.

In some embodiments, the system may include a plurality of microstrip lines, wherein each of the plurality of microstrip lines may be fabricated on the dual-mode SIW square cavity at the center of a respective side of the dual-mode SIW square cavity.

In some embodiments, each of the plurality of microstrip lines may have a port for receiving or sending a signal.

In some embodiments, at least one of the plurality of microstrip lines may have an impedance of approximately 50-Ω.

In some embodiments, the plurality of coplanar waveguide (CPW) resonators may include four CPW quarter-wavelength resonators.

In some embodiments, the SIW square cavity may operate with $TE_{201}$ and $TE_{102}$ mode resonances.

In accordance to another aspect, another substrate-integrated waveguide (SIW) filtering crossover system is disclosed. The system may include: a dual-mode substrate-integrated rectangular cavity (SIRC); a plurality of single-mode SIW square cavities; where each of the plurality of single-mode SIW square cavities may be coupled to a side of the dual-mode SIRC.

In some embodiments, the system may include a plurality of microstrip lines, where each of the plurality of microstrip lines may be fabricated on a respective SIW square cavity from the plurality of single-mode SIW square cavities.

In some embodiments, each of the plurality of microstrip lines may have a port for receiving or sending a signal.

In some embodiments, at least one of the plurality of microstrip lines may have an impedance of 50-Ω.

In some embodiments, the plurality of single-mode SIW square cavities may include eight single-mode SIW square cavities, and two of the eight single-mode SIW square cavities may be coupled to each side of the dual-mode SIRC.

In some embodiments, a first transmission route may be formed by the dual-mode SIRC and four of the eight single-mode SIW square cavities.

In some embodiments, a second transmission route may be formed by the dual-mode SIRC and the remaining four of the eight single-mode SIW square cavities.

In some embodiments, an offset variable corresponding to an offset position of a respective port of the first or second transmission route to a center line of a corresponding SIW square cavity may be configured for a port of the first or second transmission route to reject unwanted spurious resonant peaks of a received signal.

In some embodiments, the plurality of single-mode SIW square cavities may include four single-mode SIW square cavities, and one of the four single-mode SIW square cavities may be coupled to each side of the dual-mode SIRC.

In some embodiments, a first transmission route may be formed by the dual-mode SIRC and two of the four single-mode SIW square cavities.

In some embodiments, a second transmission route may be formed by the dual-mode SIRC and the remaining two of the four single-mode SIW square cavities.

In some embodiments, an offset variable corresponding to an offset position of a respective port of the first or second transmission route to a center line of a corresponding SIW square cavity may be configured for a port of the first or second transmission route to reject unwanted spurious resonant peaks of a received signal.

In some embodiments, the dual-mode SIRC may operate with $TE_{102}$ and $TE_{201}$ mode resonances.

In some embodiments, each of the plurality of single-mode SIW square cavities may operate with $TE_{101}$ mode resonances.

In accordance to yet another aspect, a substrate integrated waveguide (SIW) filtering crossover system is disclosed. The system may include: a substrate; a top metal plate placed on top of the substrate; a bottom metal plate placed beneath the substrate; a plurality of metalized via-holes in the substrate connecting the top metal plate and the bottom metal plate; and a plurality of grounded-coplanar-waveguides (GCPWs) coupled to sidewalls of the crossover system, wherein each of the GCPWs connects the crossover system to a respective microstrip line for signal transmission between the respective microstrip line and the crossover system.

In some embodiments, one or more rows of metalized via-holes in the plurality of metalized via-holes may be centered around a center of the system and may be configured based on designated width and length of a dual-mode SIRC at a center of the system to control one or more resonant frequencies of $TE_{201}$ and $TE_{102}$ modes of the dual-mode SIRC.

In some embodiments, one or more rows of metalized via-holes in the plurality of metalized via-holes may be positioned along the sidewalls of the system and may be configured based on designated sizes of one or more SIW square cavities in the system to control single-mode resonant frequencies of the SIW square cavities.

In some embodiments, the GCPWs may be configured based on required external couplings of channel filters within the system.

In some embodiments, the dual-mode SIRC may be a rectangular cavity configured to facilitate different frequencies of channel filters within the system.

In some embodiments, the one or more SIW square cavities may be configured with different sizes to facilitate different frequencies of channel filters within the system.

In some embodiments, the system may include one or more coupling windows on the sidewalls configured to control one or more internal couplings based on specified bandwidths.

In some embodiments, the system may include one or more coupling windows, each arranged at a center position of a sidewall of the dual-mode SIRC to isolate two intersecting channels in the dual-mode SIRC.

In some embodiments, the system may include one or more coupling windows, each arranged at a center position of a sidewall of one or more SIW cavities to suppress unwanted even-mode spurious resonant peaks in upper stopband of two channel filters.

In some embodiments, the one or more SIW square cavities may be orthogonally arranged to suppress spurious peaks in upper stopband.

In some embodiments, at least one of the GCPWs may be offset from a center of a SIW cavity.

BRIEF DESCRIPTION OF THE DRAWINGS

Reference will now be made, by way of example, to the accompanying figures which show example embodiments of the present application, and in which.

Like reference numerals are used throughout the Figures to denote similar elements and features. While aspects of the invention will be described in conjunction with the illustrated embodiments, it will be understood that it is not intended to limit the invention to such embodiments.

DETAILED DESCRIPTION OF EXAMPLE EMBODIMENTS

Throughout this disclosure, the term "coupled" may mean directly or indirectly connected, electrically coupled, or operably connected; the term "connection" may mean any operable connection, including direct or indirect connection. In addition, the phrase "coupled with" is defined to mean directly connected to or indirectly connected through one or more intermediate components. Such intermediate components may include both or either of hardware and software-based components.

Further, a communication interface may include any operable connection. An operable connection may be one in which signals, physical communications, and/or logical communications may be sent and/or received. An operable connection may include a physical interface, an electrical interface, and/or a data interface.

In some example embodiments described in this disclosure, the footprints of SIW filtering crossovers are reduced, resulting in compact and highly integrated SIW filtering crossover devices or systems. For example, the example SIW crossover system shown in FIG. 20 embeds multiple (e.g., four) coplanar waveguide (CPW) quarter-wavelength resonators in an oversized SIW square cavity resonating with orthogonal degenerate modes of $TE_{201}$ and $TE_{102}$. Benefitting from the usage of only one over-mode SIW cavity and the embedded scheme of CPW resonators, third-order filtering response can be realized, and more than 60% footprint reduction can be achieved compared with existing SIW crossover structures. In addition, SIW, CPW, microstrip technologies can be incorporated to implement miniaturization of filtering crossovers.

As the size of SIW filtering crossovers in this disclosure is significantly reduced compared to prior art solutions, the SIW filtering crossovers in the described embodiments below can facilitate better integration of beamforming networks for multibeam antenna systems to realize miniaturization for 5G base stations.

Figure 1A:
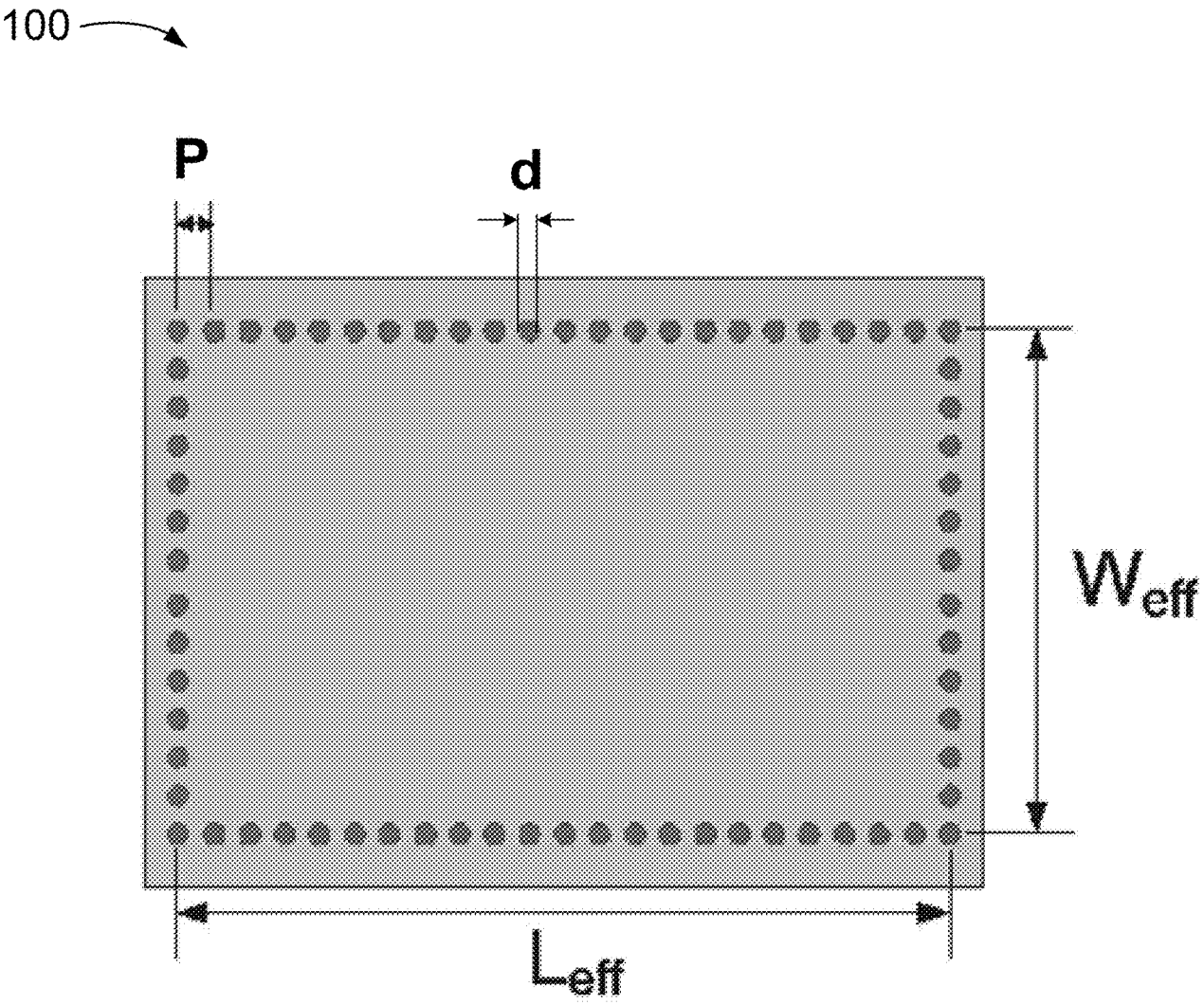
FIG. 1A illustrates an example SIW cavity resonator.
Figure 1B:
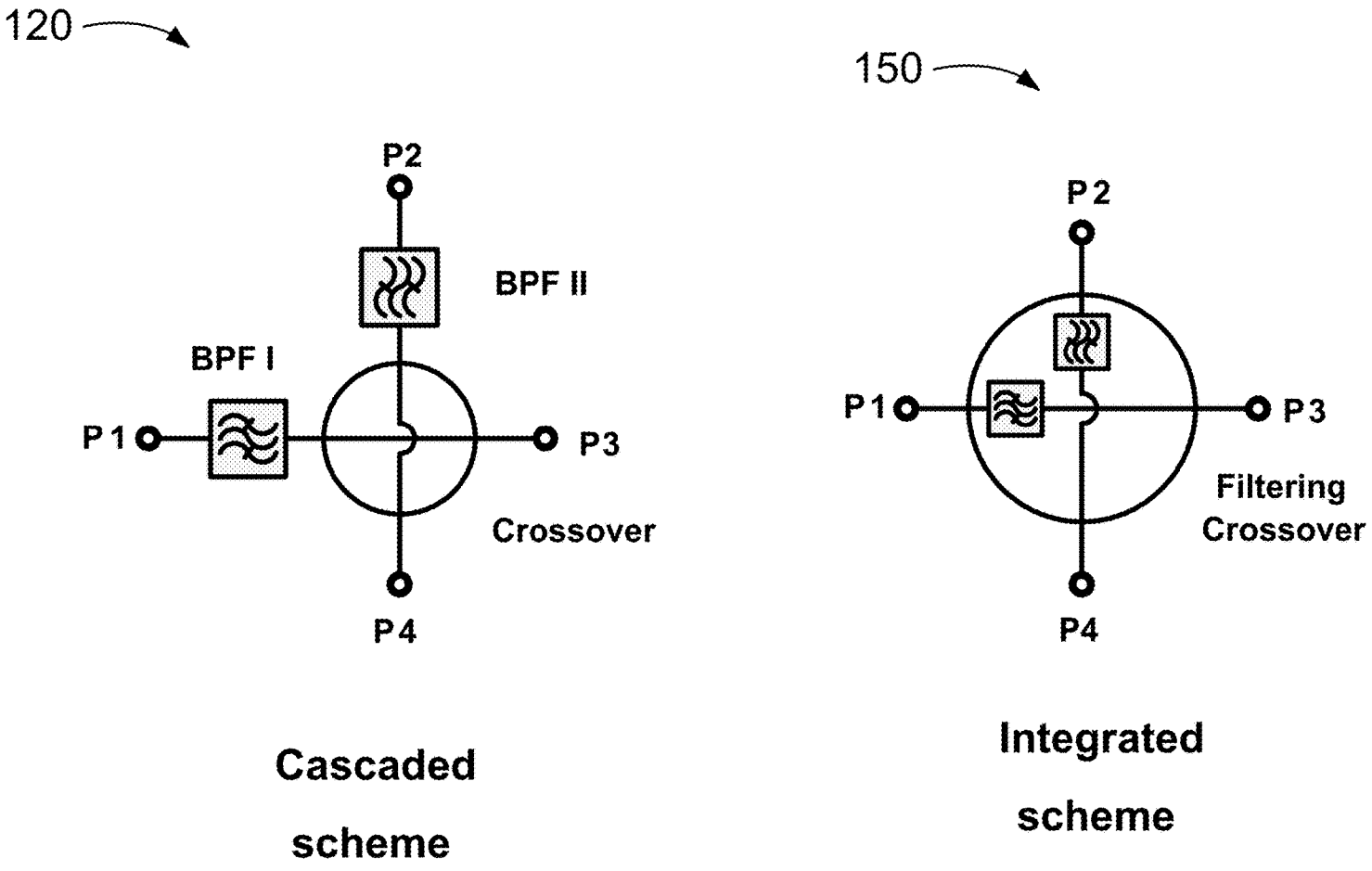
FIG. 1B illustrates two example SIW crossover schemes, one in cascaded scheme and another in integrated scheme.
Figure 2:
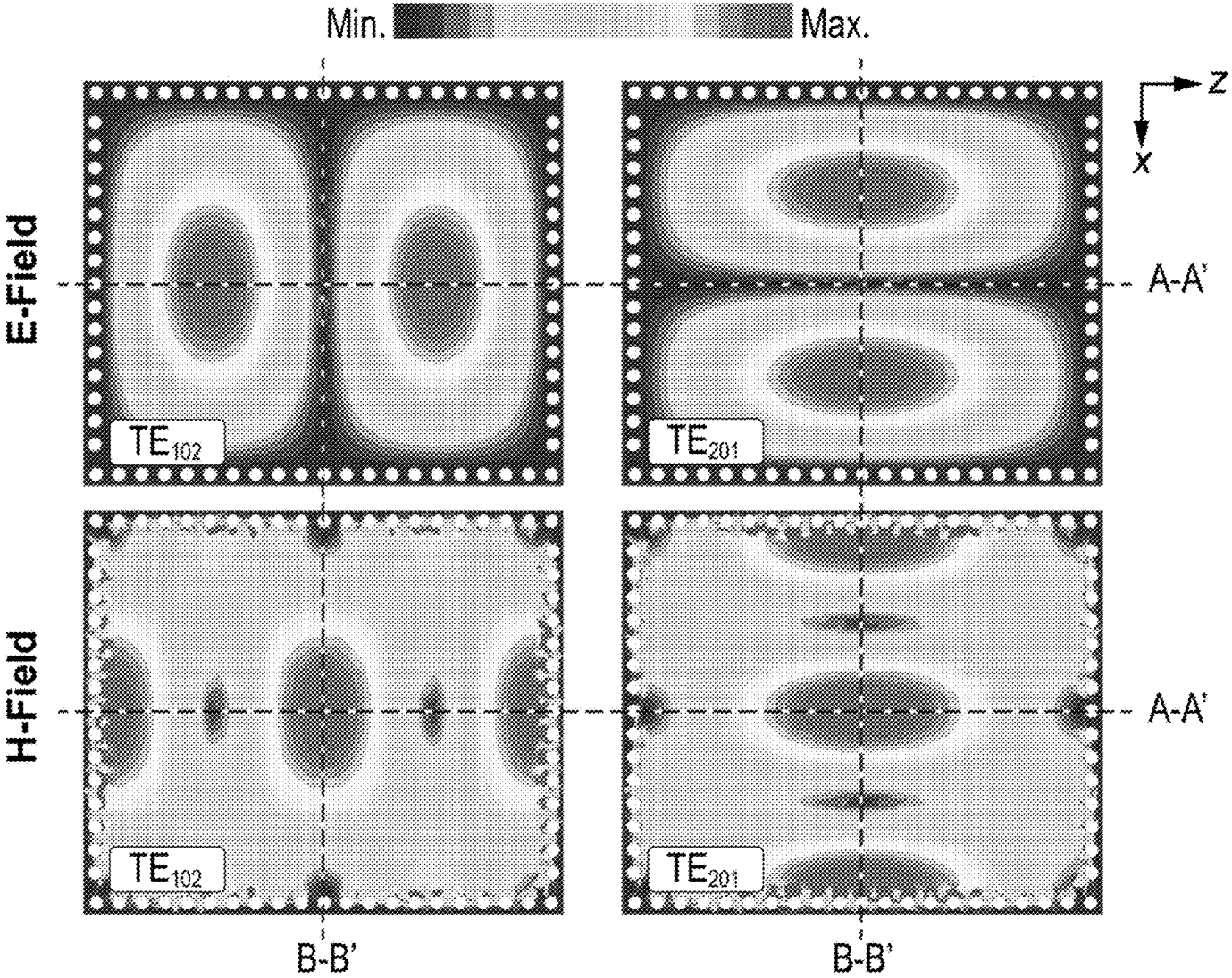
FIG. 2 illustrates electric and magnetic field magnitude distributions of orthogonal $TE_{102}$ and $TE_{201}$ modes in an SIRC.

With reference to FIG. 2, orthogonal $TE_{102}$ and $TE_{201}$ modes in a dual-mode SIRC are described first to demonstrate cross transmission and acceptable channel isolation. The CFs and BWs of the two channel passbands can be allocated flexibly and almost independently by controlling the frequencies and mutual couplings of the SIRC and multiple coupled single-mode cavities. Wide-stopband characteristics can also be implemented by incorporating three types of intrinsic spurious-mode suppression techniques including harmonic staggered method, centred coupling windows, and offset centred feeding ports.

To demonstrate the mechanism of various proposed SIW filtering crossover systems, FIG. 2 shows the magnitude distributions of electric and magnetic fields of the orthogonal $TE_{102}$ and $TE_{201}$ modes in an SIRC. It can be observed that the electric field is the weakest (i.e. Min) for $TE_{201}$ mode along the central symmetrical plane A-A', while the strongest (i.e. Max) in the x-axis for $TE_{102}$ mode along the central symmetrical plane A-A', and by the same token near the sidewalls for the magnetic field. On the contrary, the electric field is the strongest in z-axis for $TE_{201}$ mode while the weakest for $TE_{102}$ mode along the central symmetrical plane B-B', and also with the similar rules near the sidewalls for the magnetic field. Depending on these characteristics, cross transmission and excellent channel isolation may be achieved if four driven ports are placed along A-A' and B-B' to excite the dual-mode SIRC. In addition, higher-order SIW filtering crossovers with wide-stopbands and flexibly allocated CFs and BWs can be implemented with this over-mode dual-mode SIRC coupled with multiple single-mode cavities.

Figure 3:
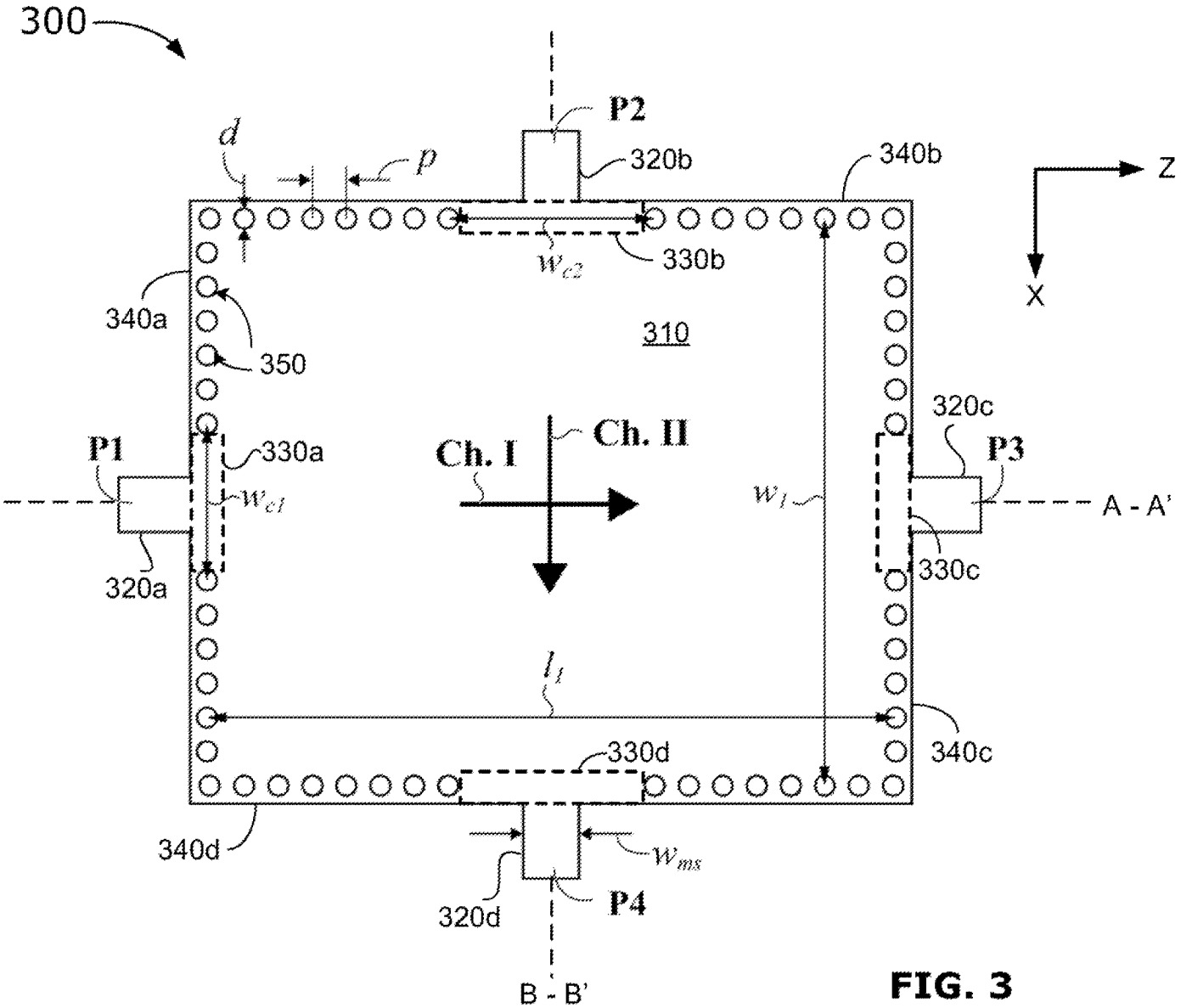
FIG. 3 illustrates an example configuration of a first-order SIW filtering crossover, in accordance with some example embodiments.

FIG. 3 illustrates an example configuration of a first-order SIW filtering crossover system 300, in accordance with some example embodiments. As shown, four 50-Ω microstrip lines 320*a*, 320*b*, 320*c*, 320*d* are placed on an over-mode dual-mode SIRC 310 at the central symmetrical planes A-A' and B-B' of the sidewalls. An over-mode dual-mode SIRC operates with two modes that are not fundamental modes. A SIRC 310 may have a top metal layer, a dielectric substrate layer, and a bottom metal layer. The dielectric substrate layer of the SIRC 310 may be characterized by $\mu_r$, the relative permeability, and $\varepsilon_r$, the relative permittivity. A microstrip 320*a*, 320*b*, 320*c*, 320*d* is a transmission line that has a conductor fabricated on the dielectric substrate of the SIRC 310 with a grounded plane. Each of the microstrip lines 320*a*, 320*b*, 320*c*, 320*d* may include a conductor having a conductor width $W_{ms}$. Each of the microstrip lines 320*a*, 320*b*, 320*c*, 320*d* may have a port for receiving or exiting signals. For example, microstrip 320*a* may have a port 1 indicated by P1, microstrip 320*b* may have a port 2 indicated by P2, microstrip 320*c* may have a port 3 indicated by P3 and microstrip 320*d* may have a port 4 indicated by P4. Throughout the figures, ports are indicated as PN, where N may be a number from 1 to 10, for example.

As shown, the first-order SIW filtering crossover system 300 has four sidewalls 340*a*, 340*b*, 340*c*, 340*d*, each sidewall 340*a*, 340*b*, 340*c*, 340*d* having a plurality of metalized via-holes 350. At each sidewall 340*a*, 340*b*, 340*c*, 340*d*, a reserved space or gap known as a coupling window 330*a*, 330*b*, 330*c*, 330*d* may be located at the center of the respective sidewall 340*a*, 340*b*, 340*c*, 340*d*, where no metalized via-holes are present. Each coupling window 330*a*, 330*b*, 330*c*, 330*d* may have a corresponding width. For example, coupling window 330*a*, 330*c* each has a width $w_{c1}$, and coupling window 330*b*, 330*d* each has a width $w_{c2}$.

The horizontal channel Ch. I from ports P1 to P3 is constructed by $TE_{102}$ mode while the vertical channel Ch. II from ports P2 to P4 is dominated by $TE_{201}$ mode. The external couplings of the two channels are controlled by widths $w_{c1}$ and $w_{c2}$ of corresponding coupling window 330*a*, 330*b*, 330*c*, 330*d*, and the width $w_1$ and length $l_1$ of the dual-mode SIRC can be figured out by equation (1) below, which is also described in K. Zhou, C.-X. Zhou, and W. Wu, "*Substrate-integrated waveguide dual-band filters with closely spaced passbands and flexibly allocated bandwidths," IEEE Trans. Compon., Packag., Manuf. Technol.*, vol. 8, no. 3, pp. 465-472, March 2018, the content of which is herein incorporated by reference in its entirety.

$$\begin{cases} W = \dfrac{c}{2\sqrt{\mu_r\varepsilon_r}}\sqrt{\dfrac{15}{4f_1^2 - f_2^2}} + \dfrac{d^2}{0.95\cdot p} \\ L = \dfrac{c}{2\sqrt{\mu_r\varepsilon_r}}\sqrt{\dfrac{15}{4f_2^2 - f_1^2}} + \dfrac{d^2}{0.95\cdot p} \end{cases} \tag{1}$$

where c is the light velocity in vacuum, $\mu_r$ and $\varepsilon_r$ are relative permeability and relative permittivity of the dielectric substrate, d is the diameter of the metalized via-holes of SIW system, and p is the pitch between adjacent via-holes, $f_1$ and $f_2$ are the resonant frequencies of $TE_{201}$ and $TE_{102}$ modes, respectively.

The circuits in this part can be implemented on Rogers RT/Duriod 5880 substrate with the relative dielectric constant $\varepsilon_r$=2.2, loss tangent tan δ=0.0009, and thickness h=0.508 mm.

Figure 4:
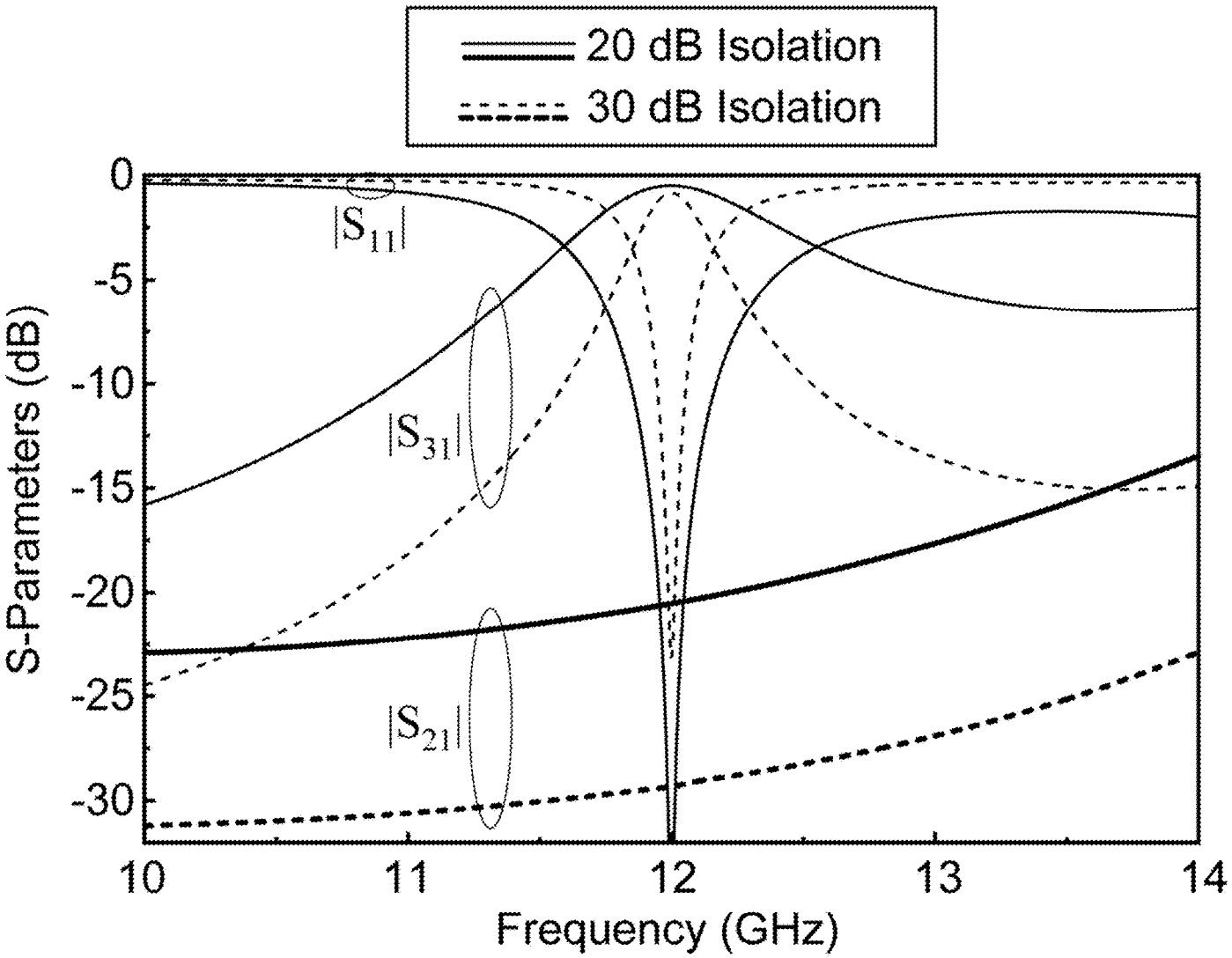
FIG. 4 illustrates the simulated frequency responses of the first-order SIW filtering crossover in FIG. 3 with identical channel center frequencies (CFs) and bandwidths (BWs).

FIG. 4 illustrates a graph showing the simulated frequency responses of the first-order SIW filtering crossover system 300 in FIG. 3 with identical channel center frequencies (CFs) and bandwidths (BWs), where frequency (GHz) is presented along the x-axis and the simulated S-Parameters (dB) along on the y-axis. Dimensions (mm) are: d=0.6, p=1, $w_{ms}$=1.55, $w_1$=$l_1$=17.26 (20 dB), $w_{c1}$=$w_{c2}$=7 (20 dB), $w_1$=$l_1$=18.24 (30 dB), $w_{c1}$=$w_{c2}$=5.5 (30 dB).

Similar to the classical crossover, the case of identical frequency responses for the two channels is demonstrated first. The isolation would degrade as $w_{c1}$ and $w_{c2}$ increase, and the emphasis is to find the maximum coupling window widths to achieve acceptable isolations. FIG. 4 shows the simulated frequency responses of the first-order SIW filtering crossover system 300 centered at $f_1$=$f_2$=12 GHz. As can be seen, $w_{c1}$=$w_{c2}$=7 mm have been attained for 20 dB isolation near the passband while $w_{c1}$=$w_{c2}$=5.5 mm can be obtained by an isolation of 30 dB isolation. Consequently, the coupling window widths $w_{c1}$ and $w_{c2}$ cannot exceed 7 mm if 20 dB isolation is required in this case while they should not exceed 5.5 mm if 30 dB isolation is needed, which is also applied to the higher-order filtering crossover systems.

Figure 5:
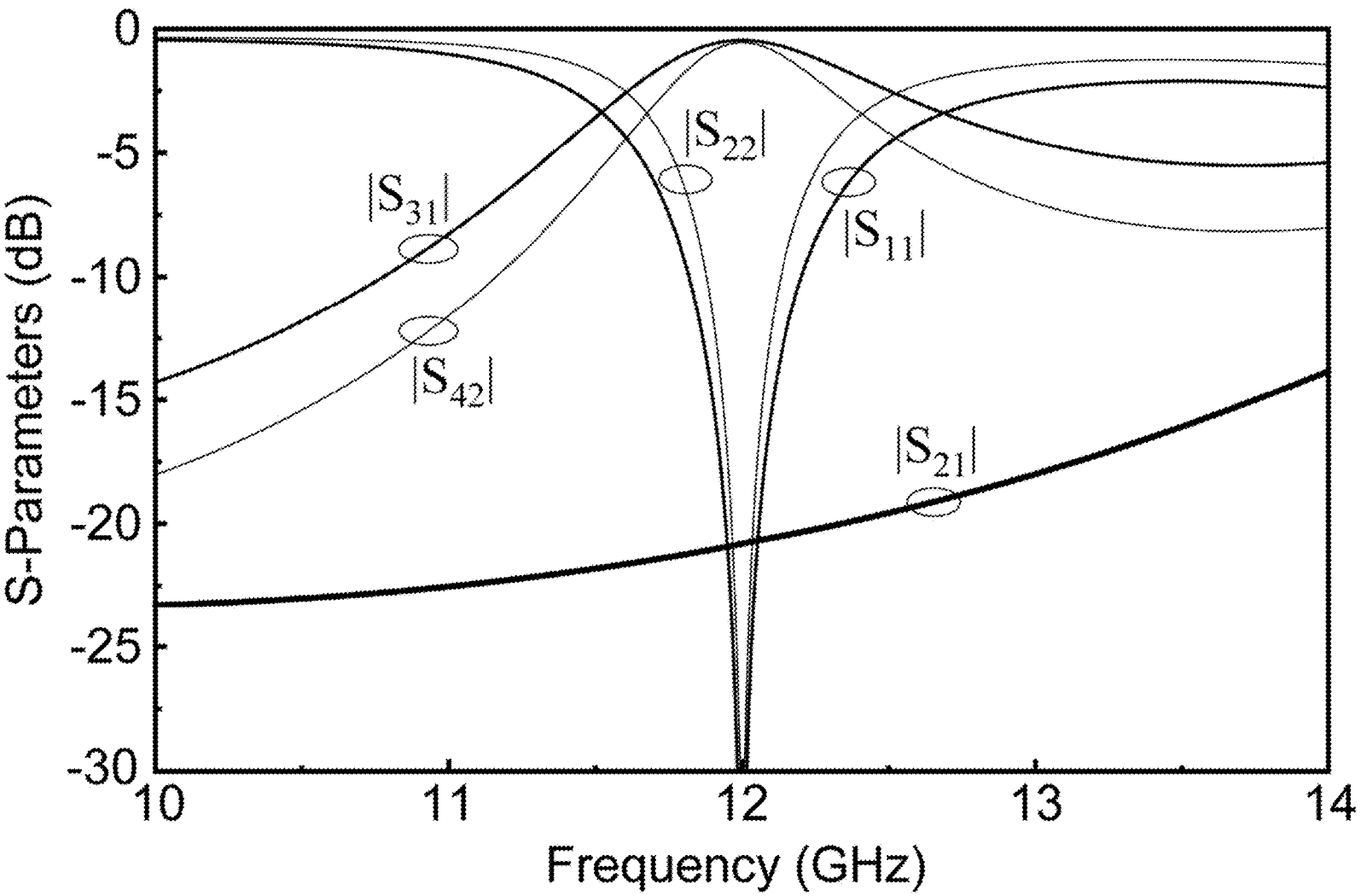
FIG. 5 illustrates the simulated frequency responses of the first-order SIW filtering crossover in FIG. 3 with identical channel CFs and different channel BWs.

FIG. 5 shows a graph illustrating the simulated frequency responses of the first-order SIW filtering crossover system 300 in FIG. 3 with identical channel CFs and different channel BWs, where frequency (GHz) is presented along the x-axis and the simulated S-Parameters (dB) along on the y-axis. Dimensions (mm) are: d=0.6, p=1, $w_{ms}$=1.55, $w_1$=17.71, $l_1$=16.92, $w_{c1}$=7.3, $w_{c2}$=6.6.

To show the diversities of allocated CFs and BWs for the crossover systems in this disclosure, another example embodiment described herein is the first-order example as shown above, with the same CFs but different BWs for the two channels, whose simulated frequency responses centered at $f_1$=$f_2$=12 GHz with BWs of 380 MHz and 250 MHz for 10-dB return losses (RLs) are depicted in FIG. 5. Compared to the case in FIG. 4, the maximum value of $w_{c1}$ increases if $w_{c2}$ is reduced to realize smaller BWs when the same 20 dB isolation near the passbands is retained.

Figure 6:
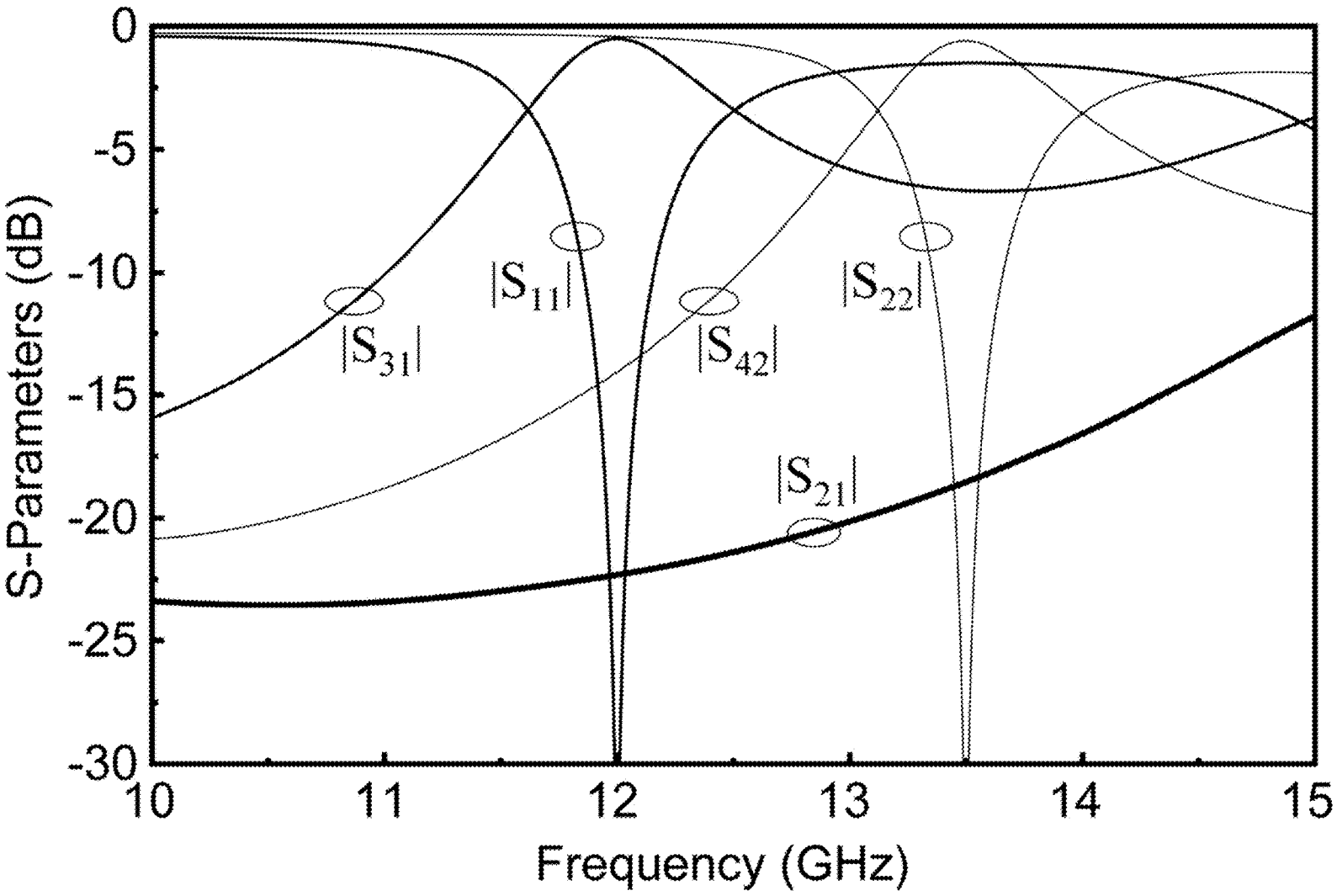
FIG. 6 illustrates the simulated frequency responses of the first-order SIW filtering crossover in FIG. 3 with different channel CFs and identical channel BWs.

FIG. 6 shows a graph illustrating the simulated frequency responses of the first-order SIW filtering crossover system 300 in FIG. 3 with different channel CFs and identical channel BWs, where frequency (GHz) is presented along the x-axis and the simulated S-Parameters (dB) along on the y-axis. Dimensions (mm) are: d=0.6, p=1, $w_{ms}$=1.55, $w_1$=15.16, $l_1$=18.13, $w_{c1}$=6.9, $w_{c2}$=6.12.

Since FIGS. 4 and 5 are concerned with the same CFs for the two channels, FIG. 6 presents the responses with the same BWs but different channel CFs, whose simulated frequency responses centered at $f_1$=12 GHz, $f_2$=13.5 GHz with both BWs (10-dB RLs) of 300 MHz. It can be seen that the maximum value of $w_{c2}$ would be reduced when the CF of Ch. II increases. Additionally, it should be pointed out that the degradation of isolation in the second channel is also attributed to its inherent uptrend caused by higher-order spurious-peaks, and by the same token in the other two cases.

Therefore, high-performance SIW filtering crossover systems with higher-order filtering functions and wide-stopband characteristics can be implemented with the topology shown in FIG. 3 using this over-mode dual-mode SIRC 310 coupled with multiple single-mode cavities, as described in detail below.

Figure 7:
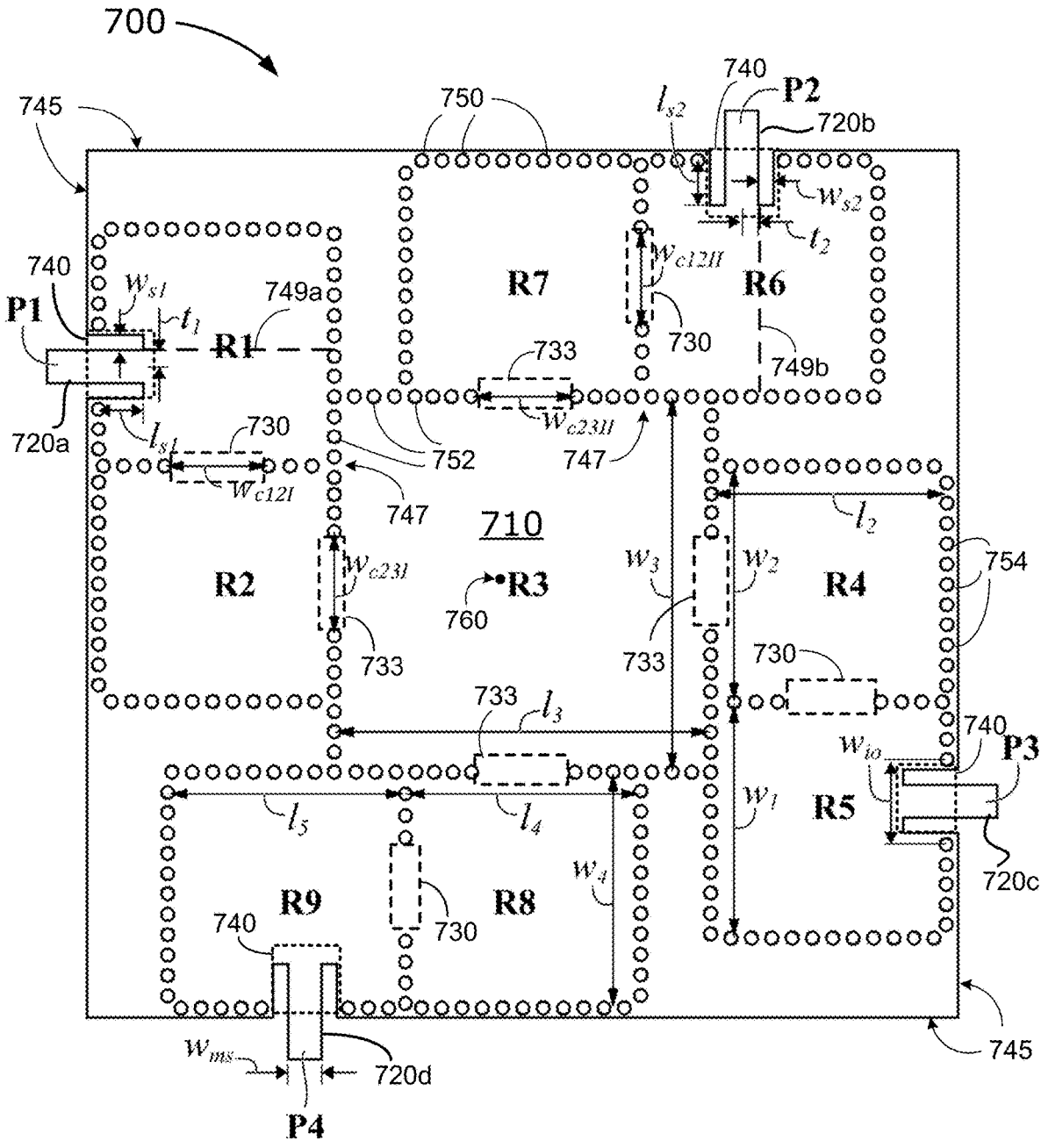
FIG. 7 illustrates an example configuration of a fifth-order SIW filtering crossover with identical channel CFs and BWs, in accordance with some example embodiments.

FIG. 7 illustrates an example configuration of a fifth-order SIW filtering crossover system 700, in accordance with some example embodiments. In this case, the dual-mode SIRC R3 710 operates with $TE_{102}$ and $TE_{201}$ mode resonances while the other eight single-mode SIW square cavities R1, R2, and R4, R5, R6, R7 R8 and R9 operate with $TE_{101}$ mode resonances. In some embodiments, in order to realize identical channel CFs and BWs, the layout is completely symmetrical about the center of R3 710. Thus, two identical transmission routings with the same fifth-order filtering responses can be constructed by R1-R2-R3-R4-R5 (e.g. corresponding to Ch. I) and R6-R7-R3-R8-R 9 (e.g. corresponding to Ch. II). The single-mode SIW square cavity R1 has a microstrip 720*a* with a port P1; the single-mode SIW square cavity R6 has a microstrip 720*b* with a port P2; the single-mode SIW square cavity R5 has a microstrip 720*c* with a port P3; and the single-mode SIW square cavity R9 has a microstrip 720*d* with a port P4, where each microstrip 720*a*, 720*b*, 720*c*, 720*d* has a conductor width $W_{ms}$.

To realize the wide-stopband performance, all the internal coupling windows and the external feeding ports can be assigned at center positions of corresponding sidewalls to suppress unwanted higher-order even-mode resonances since the magnetic fields of these modes are the weakest at these places. To efficiently reject undesired spurious resonant peaks, which may come from a received signal or from outside of the waveguide system, offset variables $t_1$ and $t_2$, can be configured for the respective I/O feeding ports P1 (e.g. corresponding to Ch. I) and P2 (e.g. corresponding to Ch. II), detailed below, where an offset variable corresponds to an offset position of a respective feeding port of a first or second transmission route to a center line of a corresponding SIW square cavity.

The system 700 may include: 1) a substrate, which may be made of, for example, a Rogers RT/Duriod 5880 substrate with the relative dielectric constant $\varepsilon_r$=2.2, loss tangent tan $\delta$=0.0009, and thickness h=0.508 mm; 2) a top metal plate placed on top of the substrate; 3) a bottom metal plate placed beneath the substrate; a plurality of metalized via-holes 750 in the substrate connecting the top metal plate and the bottom metal plate; and a plurality of grounded-coplanar-waveguides (GCPWs) 740 coupled to sidewalls 745 of the crossover system 700, where each of the GCPWs 740 connects the crossover system 700 to a respective microstrip line 720*a*, 720*b*, 720*c*, 720*d* for signal transmission between the respective microstrip line 720*a*, 720*b*, 720*c*, 720*d* and the crossover system 700.

In the crossover system 700, $W_{s1}$ and $W_{s2}$ each indicates a gap width of a feeding line of GCPWs 740; $L_{s1}$ and $L_{s2}$ each indicates a length of a feeding line of GCPWs 740; $W_{ms}$ indicates a width of a microstrip 720*a*, 720*b*, 720*c*, 720*d*; $W_{io}$ indicates a width of a feeding port; $t_1$ and $t_2$ each indicates an offset from a center line 749*a*, 749*b* of a SIW cavity R1, R6 (indicated as the dotted straight lines); $W_{c12I}$, $W_{c23I}$, $W_{c12II}$, $W_{c23II}$ each indicates a respective width of coupling windows 730 or 733; $w_1$, $w_2$, $w_3$, and $w_4$ each indicates a width of a respective SIRC resonator (or SIW cavity) R5, R4, R3, R8, R9; and $l_2$, $l_3$, $l_4$, and $l_5$ each indicates a length of a respective SIRC resonator (or SIW cavity) R4, R3, R8, R9.

In some embodiments, one or more rows of metalized via-holes 752 in the plurality of metalized via-holes 750 are centered around a center 760 of the system 700 and configured based on designated width and length of a SIW cavity R3 to control one or more resonant frequencies of $TE_{201}$ and $TE_{102}$ modes of the SIW cavity R3.

In some embodiments, one or more rows of metalized via-holes 754 in the plurality of metalized via-holes 750 are positioned along the sidewalls 745 of the system and configured based on designated sizes of one or more SIW square cavities (e.g., R1, R2, R4, R5, R6, R7, R8 or R9) in the system 700 to control single-mode resonant frequencies of the SIW square cavities R1, R2, R4, R5, R6, R7, R8 or R9.

In some embodiments, the GCPWs 740 are configured based on required external couplings of one or more channel filters within the system 700.

In some embodiments, the SIW cavity R3 may be a rectangular cavity configured to facilitate different frequencies of channel filters within the system 700.

In some embodiments, the one or more SIW square cavities R1, R2, R4, R5, R6, R7, R8 or R9 may be configured with different sizes to facilitate different frequencies of channel filters within the system 700.

In some embodiments, the system 700 may include one or more reserved spaces or coupling windows 730,733 on the sidewalls 745, 747 configured to control one or more internal couplings of filtering circuits based on specified bandwidths.

In some embodiments, the system 700 may include one or more coupling windows 733, each arranged at a center position of a sidewall 747 of a center SIW cavity R3 to isolate two intersecting channels in the center SIW cavity R3.

In some embodiments, the system 700 may include one or more coupling windows 730, each arranged at a center position of a sidewall 745 of one or more SIW cavities R1, R2, R4, R5, R6, R7, R8 or R9 to suppress unwanted even-mode spurious resonant peaks in upper stopband of two channel filters.

In some embodiments, the one or more SIW square cavities R1, R2, R4, R5, R6, R7, R8 or R9 are orthogonally arranged to suppress spurious peaks in upper stopband. For example, the coupling routes may be positioned to form a "Z" topology.

In some embodiments, at least one of the GCPWs 740 has an offset t1, t2 from a center of a SIW cavity R1, R6. The center of the SIW cavity R1, R6 is located along the dotted line, which indicates a central plane 749*a* in SIW cavity R1 (or central plane 749*b* in SIW cavity R6).

This fifth-order crossover is synthesized with Chebyshev filtering responses and 20-dB RLs in the two channel passbands centered at $f_1$=$f_2$=12 GHz with ripple fractional-BWs (FBWs) $\Delta_1$=$\Delta_2$=6.5%. The corresponding normalized coupling matrix can be obtained by equation (2) below. Subsequently, the design parameters could be calculated by de-normalizing the coupling matrix [m] and then the circuit can be designed accordingly, where $q_e$ denotes the normalized external quality factor between the feeding ports and the first/last resonators.

$$[m] = \begin{bmatrix} 0 & 0.8653 & 0 & 0 & 0 \\ 0.8653 & 0 & 0.6357 & 0 & 0 \\ 0 & 0.6357 & 0 & 0.6357 & 0 \\ 0 & 0 & 0.6357 & 0 & 0.8653 \\ 0 & 0 & 0 & 0.8653 & 0 \end{bmatrix} \quad (2)$$

$$q_e = 0.9732$$

Figure 8:
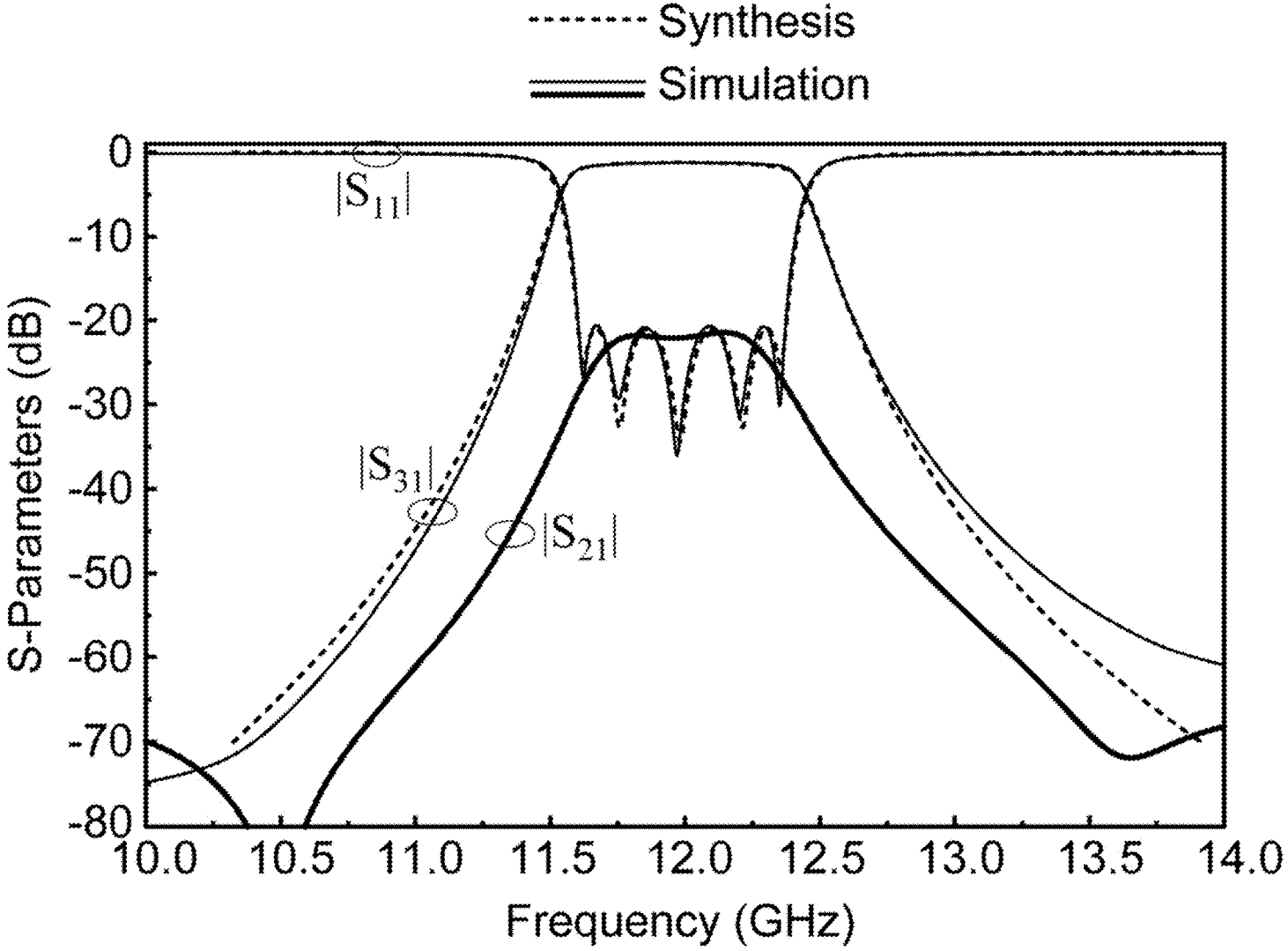
FIG. 8 illustrates synthesized and simulated near-band frequency responses of the fifth-order SIW filtering crossover in FIG. 7 with identical channel CFs and BWs.

FIG. 8 illustrates synthesized and simulated near-band frequency responses of the fifth-order SIW filtering crossover system 700 in FIG. 7 with identical channel CFs and BWs, where frequency (GHz) is presented along the x-axis and the simulated S-Parameters (dB) along on the y-axis. Dimensions (mm) are: d=0.6, p=1, $w_{ms}$=1.55, $w_{io}$=4.2, $w_1$=$l_5$=11.67, $w_2$=$l_2$=$w_4$=$l_4$=11.61, $w_3$=$l_3$=18.56, $w_{c12I}=w_{c12II}=5.16$, $w_{c23I}=w_{c23II}=5.1$, $w_{s1}=w_{s2}=0.8$, $l_{s1}=l_{s2}=2.2$, $t_1=t_2=0.9$. Substrate is a Rogers RT/Duriod 5880 substrate with h=0.508 mm.

The simulated near-band frequency responses of the crossover as well as the synthesized coupling matrix responses with average unloaded quality factor $Q_u=360$ are plotted in FIG. 8, which can be observed to be in excellent agreement. Taking into account all the losses including conductor, dielectric, and radiation losses, the simulated minimum insertion loss (IL) in the channel passband is 1.23 dB with reflection loss (RL) better than 20.6 dB, while the simulated ripple-BW is 770 MHz ($\Delta_1=\Delta_2=6.42\%$) with 3-dB BW of 890 MHz, and the channel isolation is better than 21.5 dB over the interested band.

Figure 9B:
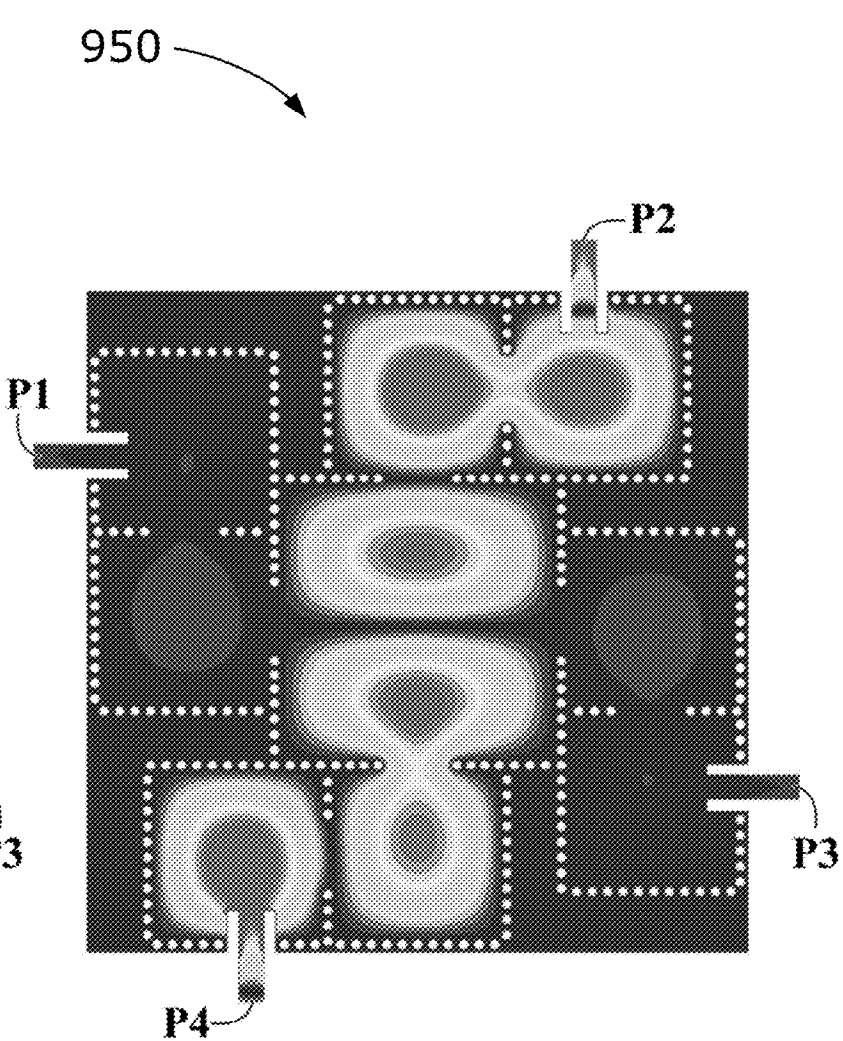
FIG. 9B illustrates electric field magnitude distributions of the two intersecting channels for the fifth-order SIW filtering crossover in FIG. 7 with excitation of port P2.
Figure 9A:
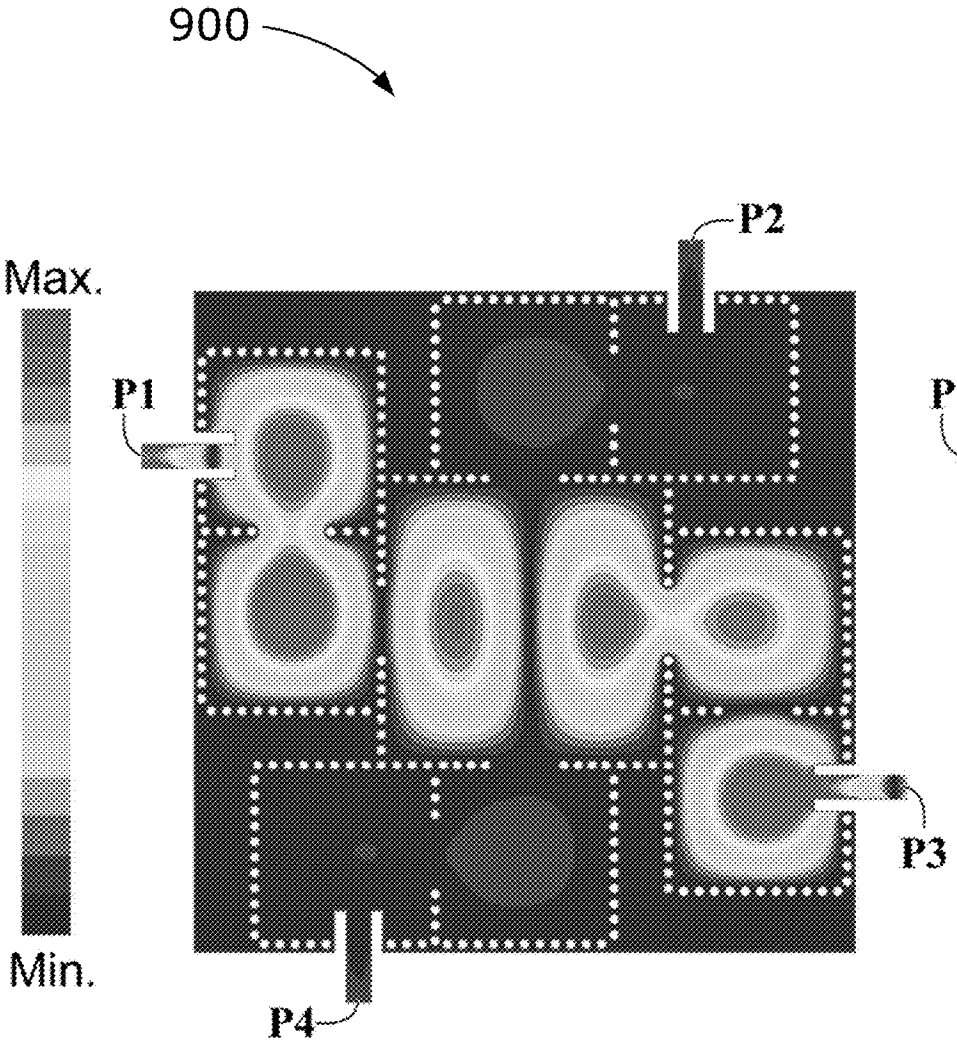
FIG. 9A illustrates electric field magnitude distributions of the two intersecting channels for the fifth-order SIW filtering crossover in FIG. 7 with excitation of port P1.

FIGS. 9A and 9B depict the electric field magnitude distributions of the two intersecting channels. FIG. 9A illustrates electric field magnitude distributions 900 of the two intersecting channels for the fifth-order SIW filtering crossover system 700 in FIG. 7 with excitation of port P1. FIG. 9B illustrates electric field magnitude distributions 950 of the two intersecting channels for the fifth-order SIW filtering crossover system 700 in FIG. 7 with excitation of port P2. It can be seen that the horizontal channel from P1 to P3 is dominated by $TE_{101}$ modes of R1, R2, R4, R5, and $TE_{102}$ mode of R3, while the vertical channel from P2 to P4 is constructed by $TE_{101}$ modes of R6-R9 and $TE_{201}$ mode of R3. Additionally, almost no energy can be seen to be transmitted to adjacent channel when one channel is excited, leading to an acceptable channel isolation.

Figure 10:
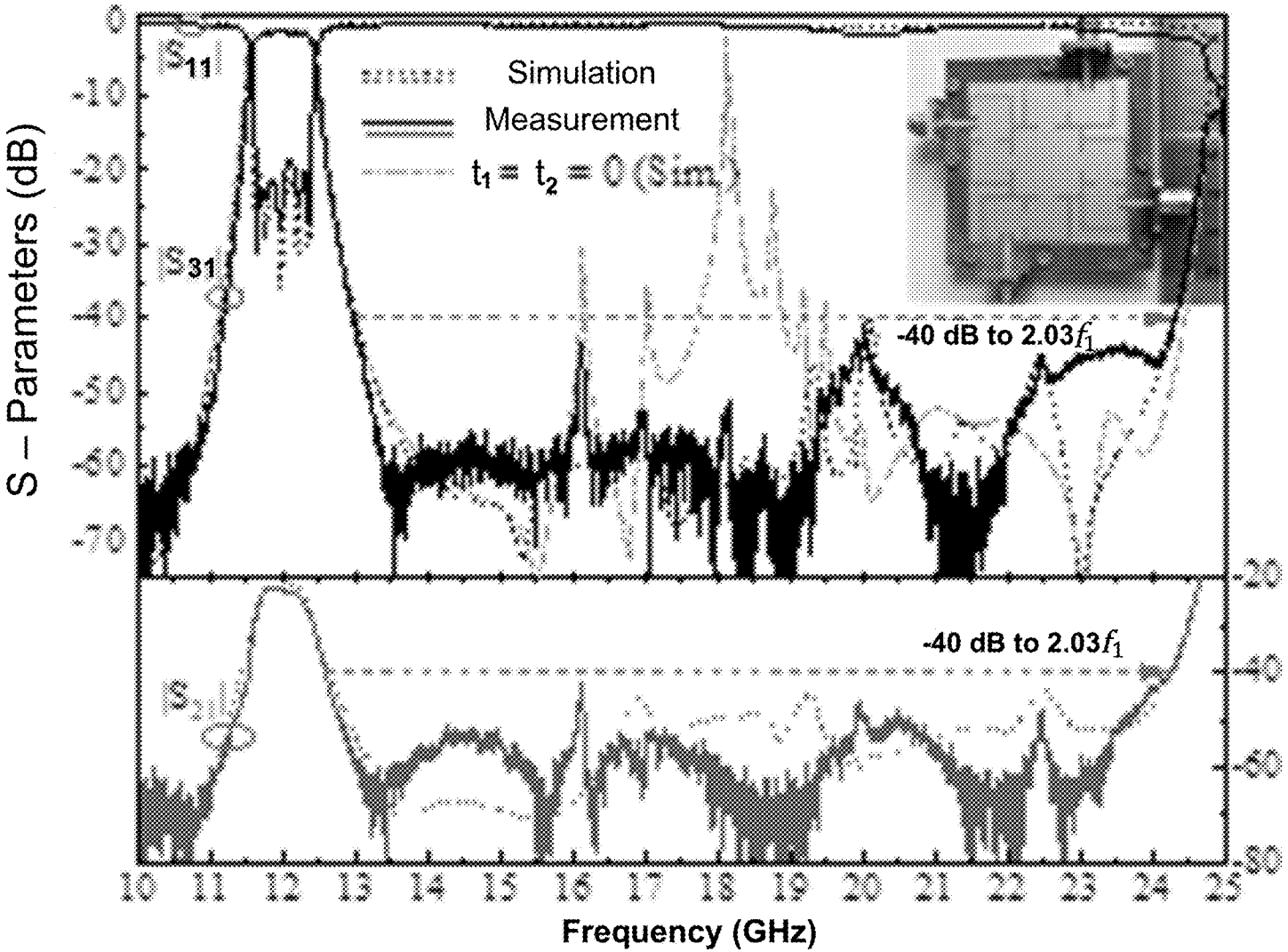
FIG. 10 shows a comparison between measured and simulated wideband frequency responses of the fifth-order SIW filtering crossover in FIG. 7.

FIG. 10 shows a comparison between measured and simulated wideband frequency responses of the fifth-order SIW filtering crossover system 700 in FIG. 7, where frequency (GHz) is presented along the x-axis and S-Parameters (dB) along on the y-axis, and in which the inset is the photograph of the fabricated prototype with overall circuit size of 42.4 mm×42.4 mm ($2.52\lambda_g\times2.52\lambda_g$), where $\lambda_g=c/f_1/\varepsilon_r^{1/2}$. Good agreement can be observed between the measured and simulated results, and the measured insertion loss (IL) in the channel passband is 1.41 dB with reflection loss (RL) better than 18.5 dB, while the measured 3-dB BW is 860 MHz with channel isolation better than 21.8 dB across the passband.

Benefitting from the three types of intrinsic spurious-mode suppression techniques including harmonic staggered method, centered coupling windows, and offset centered feeding ports, wide-stopband up to $2.03f_1$ is obtained with the suppression better than 40 dB.

Figure 11:
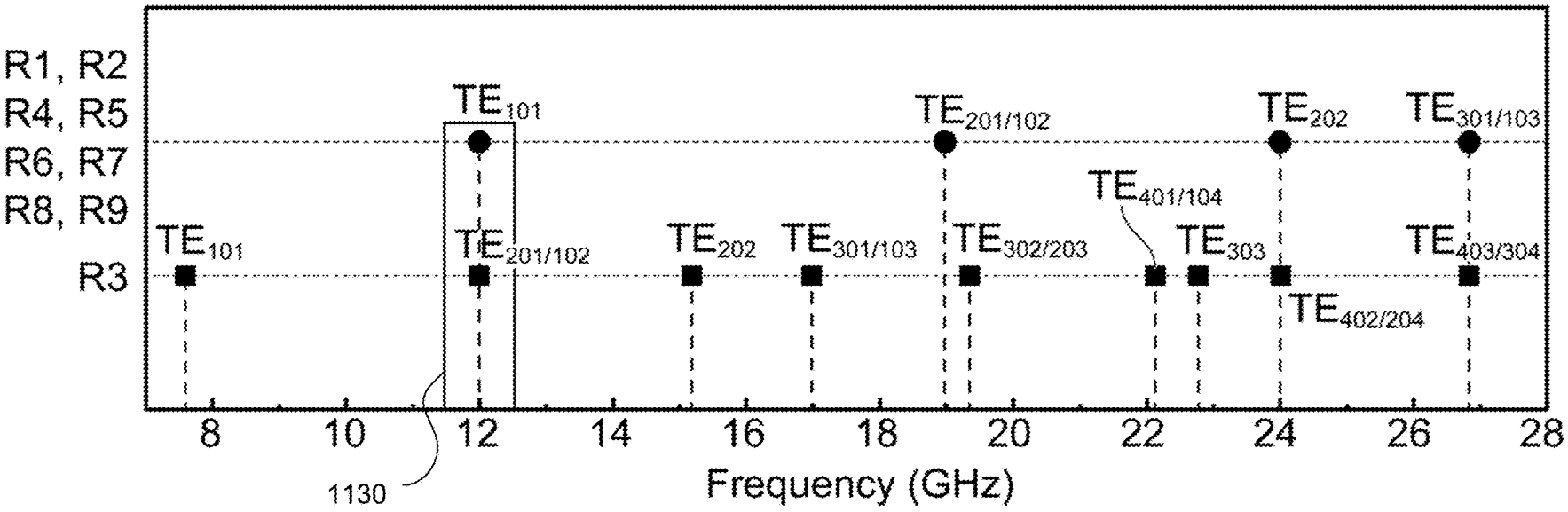
FIG. 11 shows frequency distributions of leading resonant modes in constitutive cavities of the fifth-order SIW filtering crossover in FIG. 7.

FIG. 11 shows frequency distributions of leading resonant modes in constitutive cavities of the fifth-order SIW filtering crossover in FIG. 7, where frequency (GHz) is presented along the x-axis and the type of SIRC (e.g. dual-mode SIRC R3 or single-mode SIRC R1, R2, R4-R9) along on the y-axis. Box 1130 indicates the position of two channel passbands. It can be seen that the higher-order resonances are irregularly distributed on the frequency spectrum up to 24 GHz for these two types of SIRCs, thus the harmonic staggered technique can be utilized here to realize wide-stopband performance. Nevertheless, technique of this kind coordinated with the centered coupling windows and centered feeding ports can generally be applied to BPFs with narrow BWs. For moderate or wide BWs, the spurious peaks in the stopband would usually rise, as the dash-dotted $|S_{31}|$ curve shown in FIG. 10. The reason why these even-mode spurious resonant peaks cannot be rejected to lower levels is that the field symmetry is influenced by the ports and wide coupling windows. Consequently, offset variables t1 and t2 are arranged here for the feeding ports (such as P1 and P2) to find the proper positions of the weakest fields to realize a true suppression of these spurious resonances.

Figure 12:
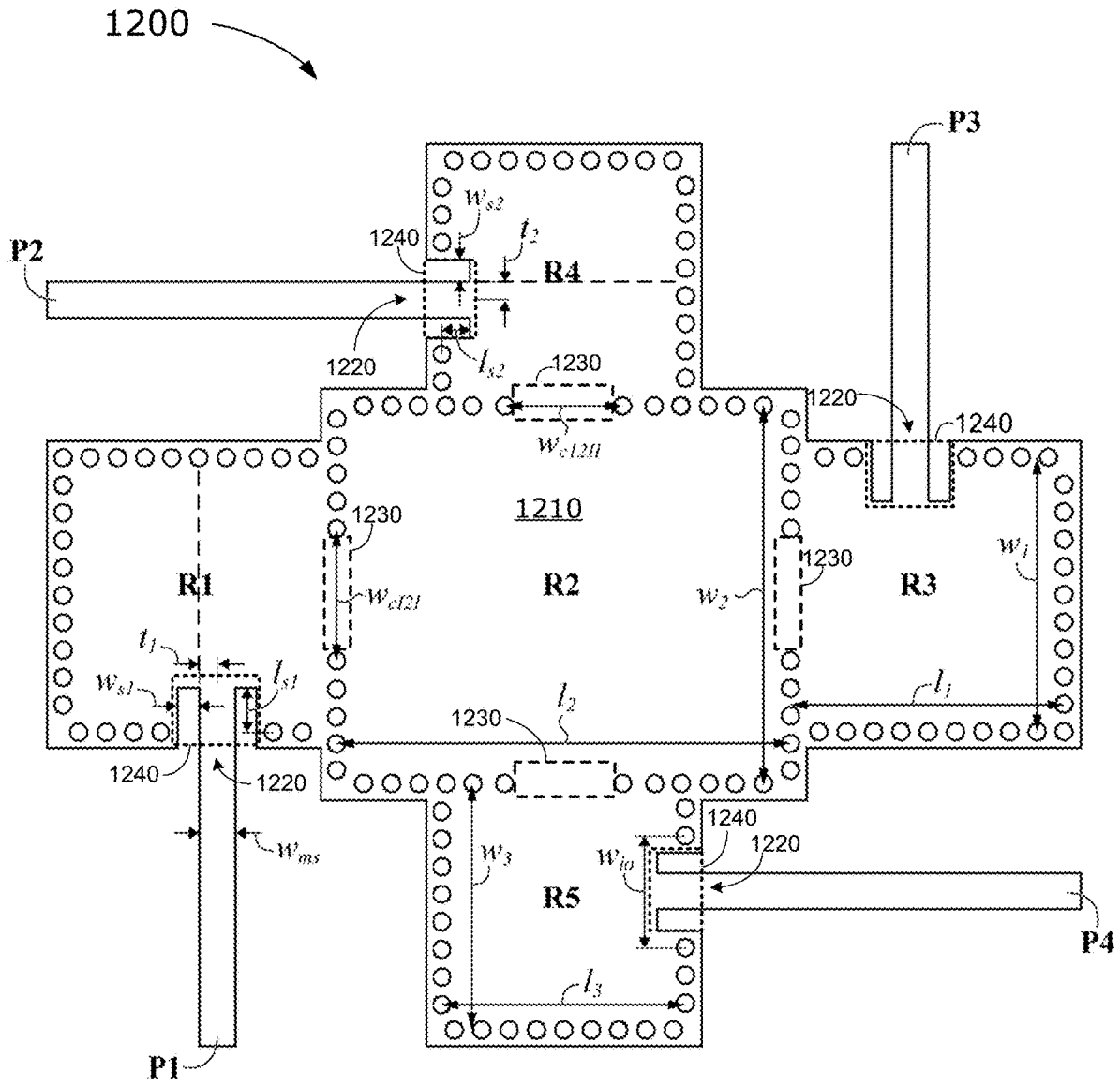
FIG. 12 illustrates an example configuration of the third-order SIW filtering crossover, in accordance with some example embodiments.

FIG. 12 illustrates an example configuration of the third-order SIW filtering crossover system 1200, in accordance with some example embodiments. The third-order wide-stopband SIW filtering crossover system 1200 with different channel CFs or BWs. In this case, the dual-mode SIRC R2 1210 operates with $TE_{102}$ and $TE_{201}$ mode resonances while the other single-mode square cavities R1, R3, R4, and R5 operate with $TE_{101}$ mode resonances. Here the two transmission routings with different third-order responses are constructed by R1-R2-R3 (e.g. corresponding to Ch. I) and R4-R2-R5 (e.g. corresponding to Ch. II). Similarly, all the internal coupling windows are arranged at the center positions of corresponding sidewalls to suppress undesired higher-order even-mode resonances to achieve wide-stopband performance, and the offset variables $t_1$ and $t_2$ are also configured for the I/O feeding ports P1 (e.g. corresponding to Ch. I) and P2 (e.g. corresponding to Ch. II), respectively, to reject unwanted spurious resonant peaks more efficiently. Different from the fifth-order example, this third-order crossover is synthesized and designed with different channel CFs or BWs.

In the crossover system 1200, $W_{s1}$ and $W_{s2}$ each indicates a gap width of a feeding line of GCPWs 1240; $L_{s1}$ and $L_{s2}$ each indicates a length of a feeding line of GCPWs 1240; $W_{ms}$ indicates a width of a microstrip 1220; $W_{io}$ indicates a width of a feeding port; $t_1$ and $t_2$ each indicates an offset from a center line of a SIW cavity R1, R4 (indicated as the dotted straight lines); $W_{c12I}$ and $W_{c12II}$ each indicates a respective width of coupling windows 1230; $w_1$, $w_2$, and $w_3$ each indicates a width of a respective SIRC resonator (or SIW cavity) R1 or R3, R2, R4 or R5; and $l_1$, $l_2$, and $l_3$ each indicates a length of a respective SIRC resonator (or SIW cavity) R1 or R3, R2, R4 or R5.

To demonstrate the flexibility in the allocations of channel CFs and BWs, this third-order crossover is first synthesized with Chebyshev responses and 20-dB RLs for the passbands centered at $f_1=f_2=12$ GHz with the respective ripple-FBWs of $\Delta_1=5.6\%$ and $\Delta_2=3.75\%$. The corresponding normalized coupling matrix [m] can be obtained as (3) for both channels, then the circuit can be designed accordingly, where $q_e$ denotes the normalized external quality factor between the feeding ports and the first/last resonators.

$$[m]=\begin{bmatrix} 0 & 1.0303 & 0 \\ 1.0303 & 0 & 1.0303 \\ 0 & 1.0303 & 0 \end{bmatrix} \quad (3)$$

$$q_e = 0.8534$$

Figure 13:
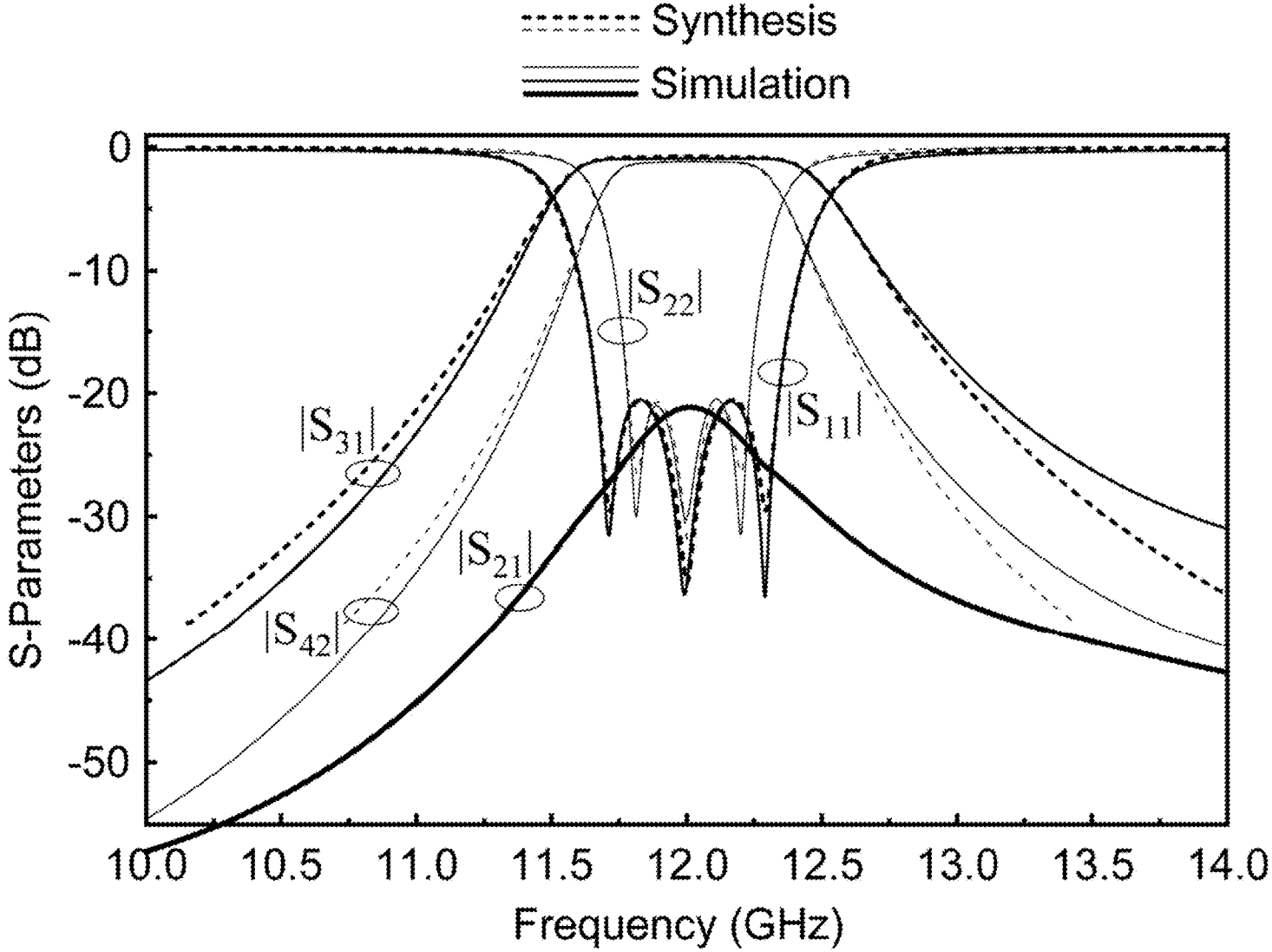
FIG. 13 illustrates synthesized and simulated near-band frequency responses of the third-order SIW filtering crossover in FIG. 12 with the same channel CFs and different channel BWs.

FIG. 13 illustrates synthesized and simulated near-band frequency responses of the third-order SIW filtering crossover system 1200 in FIG. 12 with the same channel CFs and different channel BWs, where frequency (GHz) is presented along the x-axis and S-Parameters (dB) along on the y-axis, as well as the synthesized coupling matrix responses with average $Q_u=300$. It can be observed that the average $Q_u$ here is smaller than that in the fifth-order crossover because the circuits in this part are designed and fabricated on Rogers RT/Duriod 6002 substrate with $\varepsilon_r=2.94$, tan $\delta=0.0012$, and h=0.508 mm. Taking into account all the losses, the simulated minimum ILs in the two passbands are respective 0.92 and 1.18 dB with RLs better than 20.5 dB, while the simulated ripple-BWs are 670 and 450 MHz ($\Delta_1=5.58\%$, $\Delta_2$=3.75%) with 3-dB BWs of 1020 and 680 MHz, and the channel isolation is better than 21.2 dB across the passbands. Dimensions (mm) are: d=0.6, p=1, $w_{ms}$=1.55, $w_{io}$=4.1, $w_1$=$l_1$=9.96, $w_2$=16.17, $l_2$=15.81, $w_3$=$l_3$=10.07, $w_{c12I}$=5, $w_{c12II}$=4.4, $w_{s1}$=$w_{s2}$=0.8, $l_{s1}$=1.63, $l_{s2}$=1.09, $t_1$=0.63, $t_2$=0.52. Substrate is a Rogers RT/Duriod 6002 substrate with h=0.508 mm.

Figure 14B:
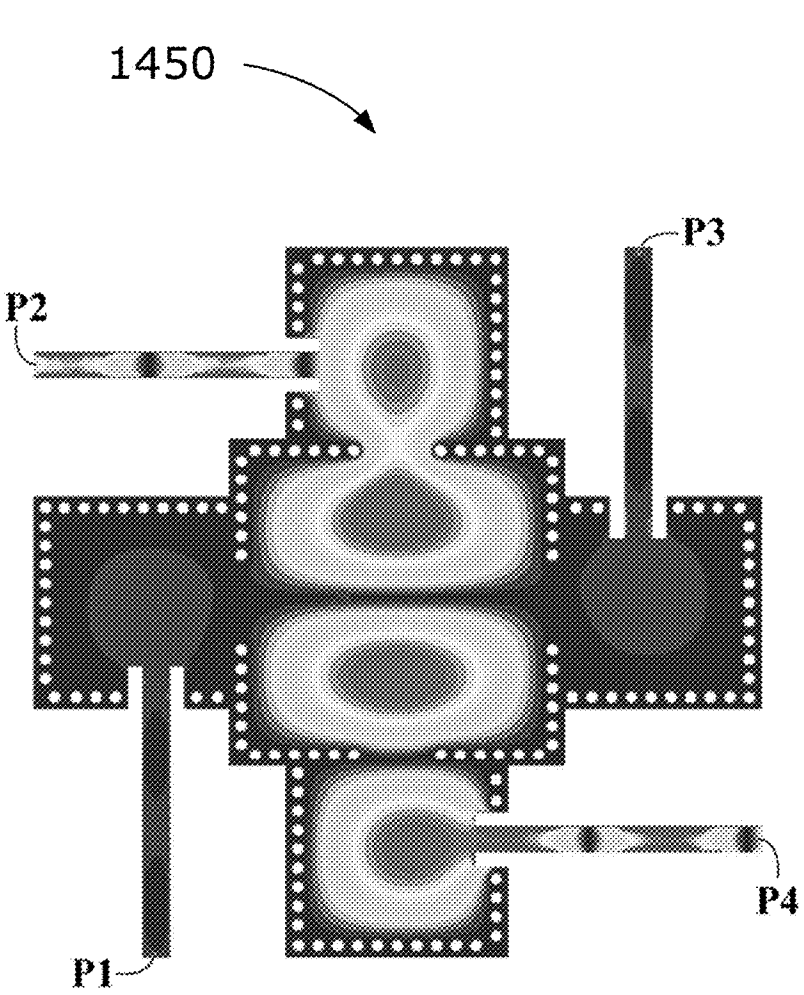
FIG. 14B illustrates electric field magnitude distributions of the two intersecting channels for the third-order SIW filtering crossover in FIG. 12 with the same channel CFs and different channel BWs with excitation of port P2.
Figure 14A:
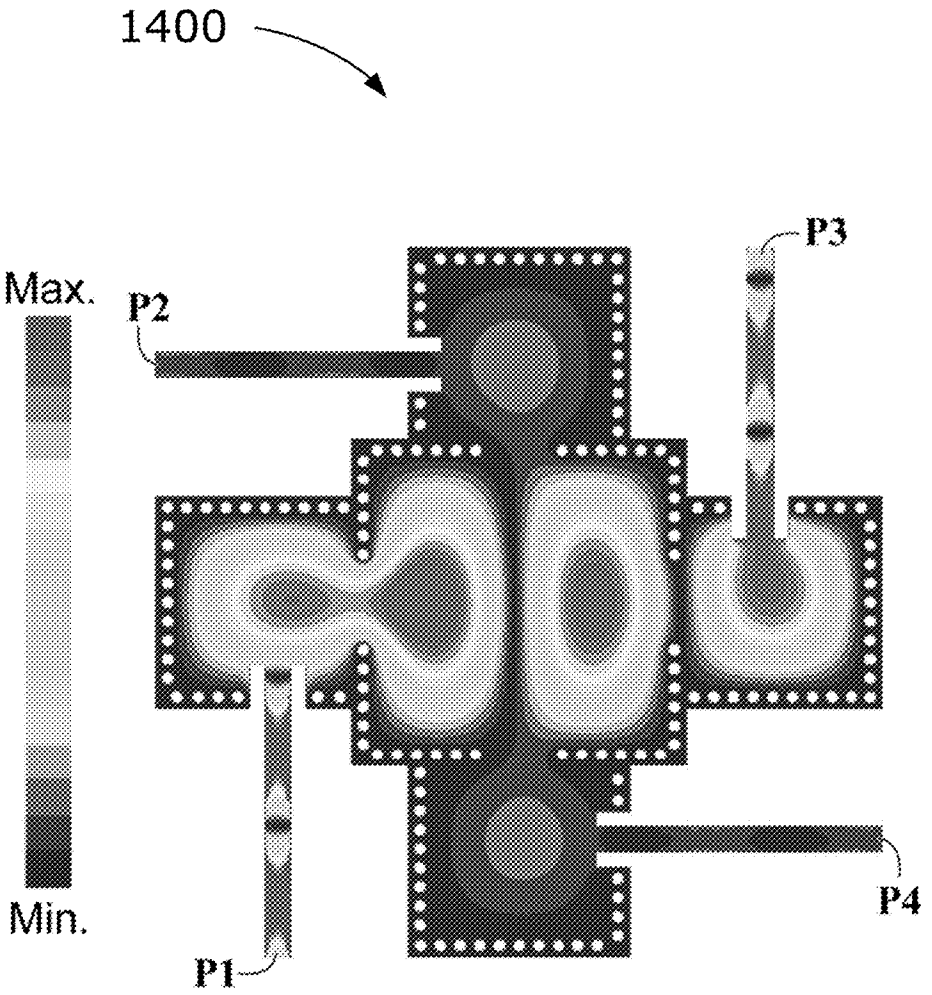
FIG. 14A illustrates electric field magnitude distributions of the two intersecting channels for the third-order SIW filtering crossover in FIG. 12 with the same channel CFs and different channel BWs with excitation of port P1.

FIG. 14A illustrates electric field magnitude distributions 1400 of the two intersecting channels for the third-order SIW filtering crossover system 1200 in FIG. 12 with the same channel CFs and different channel BWs with excitation of port P1. FIG. 14B illustrates electric field magnitude distributions 1450 of the two intersecting channels for the third-order SIW filtering crossover system 1200 in FIG. 12 with the same channel CFs and different channel BWs with excitation of port P2. Similar to the fifth-order design, the horizontal channel from ports P1 to P3 is constructed by $TE_{101}$ modes of R1, R3, and $TE_{102}$ mode of R2, while the vertical channel from ports P2 to P4 is dominated by $TE_{101}$ modes of R4, R5, and $TE_{201}$ mode of R2. Additionally, little energy could be observed to be transmitted to adjacent channel when one channel is excited.

Figure 15:
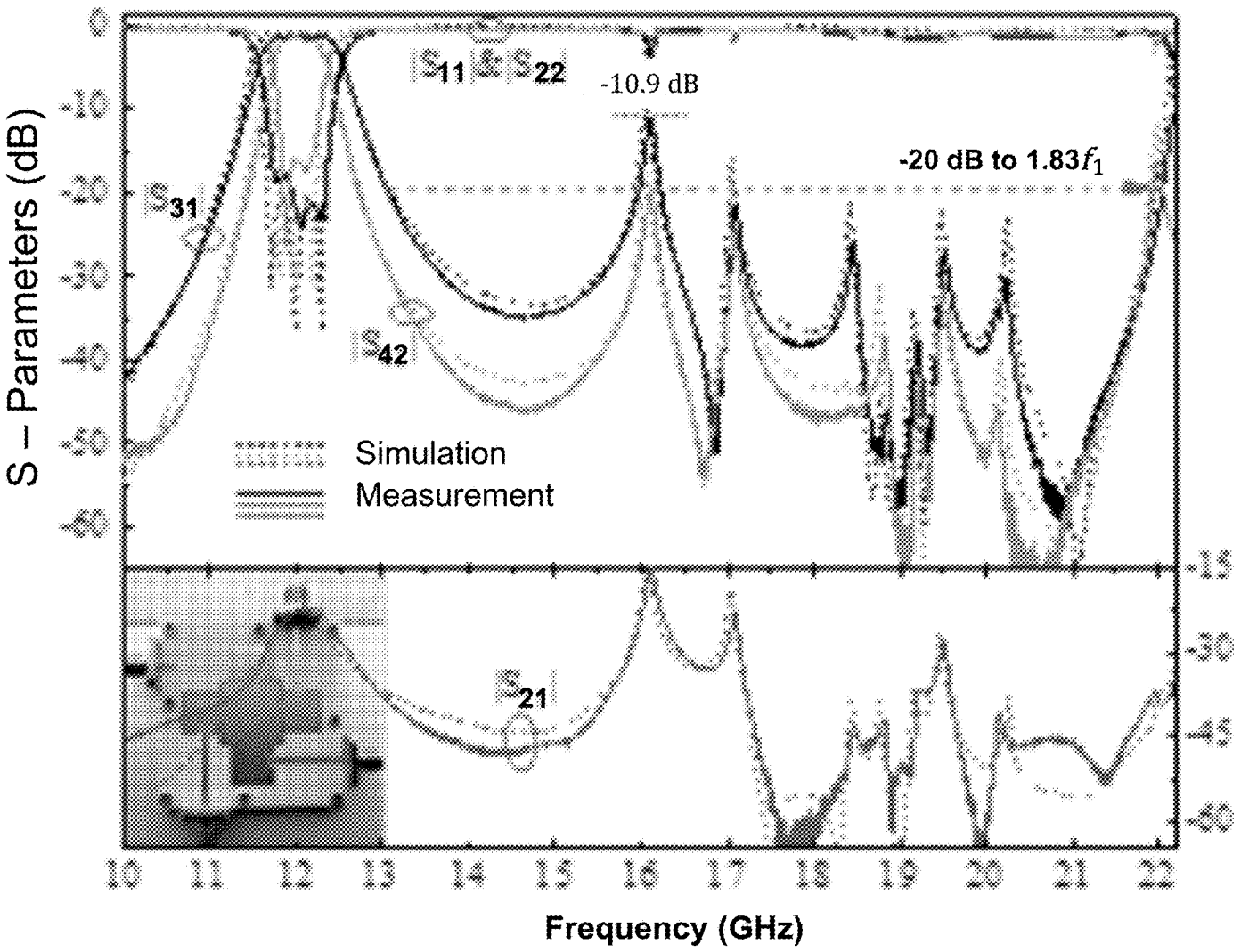
FIG. 15 illustrates a comparison between measured and simulated wideband frequency responses of the third-order SIW filtering crossover in FIG. 12.

FIG. 15 illustrates a comparison between measured and simulated wideband frequency responses of the third-order SIW filtering crossover in FIG. 12, where frequency (GHz) is presented along the x-axis and S-Parameters (dB) along on the y-axis, and in which the inset is the photograph of the fabricated prototype with overall circuit size of 36.4 mm×35.8 mm ($2.50\lambda_g$=$2.46\lambda_g$). The measured ILs in the two passbands are 1.26 and 1.65 dB with RLs better than 15.9 and 17.9 dB, respectively, while the measured 3-dB BWs are 950 and 620 MHz with isolation better than 21.9 dB within the passbands. Thanks to the combination of the three kinds of intrinsic spurious-mode suppression techniques, the stopband is extended to $1.83f_1$ with suppression level better than 20 dB except a spurious peak arose at 16.1 GHz with level of 10.9 dB, and the isolation is always better than 15 dB across the whole wideband. Since the constitutive cavities of this example resonant at the same frequencies as those in the fifth-order design, the frequency spectrum distributions of the resonant modes are identical as those in FIG. 11.

Figure 16:
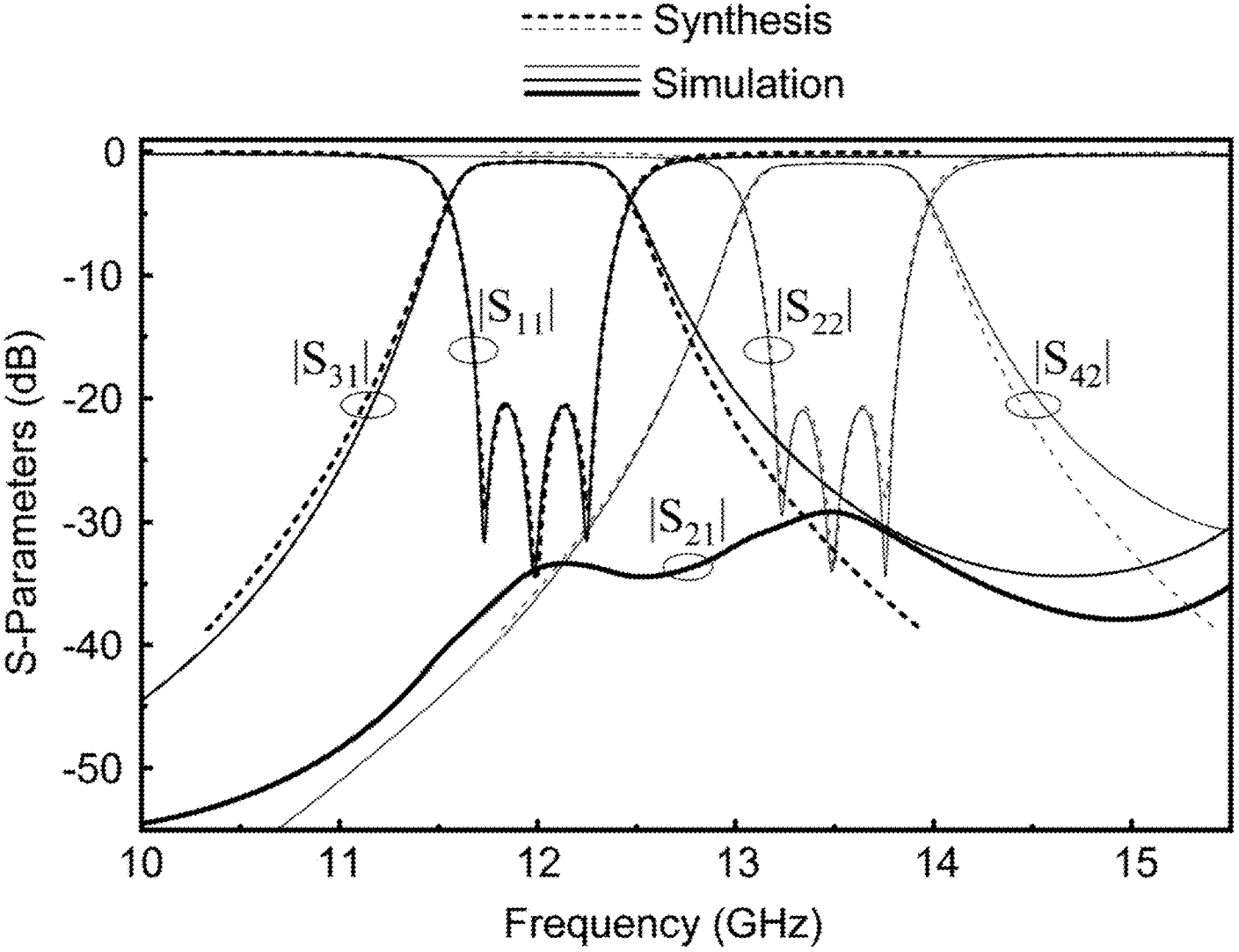
FIG. 16 illustrates synthesized and simulated near-band frequency responses of the third-order SIW filtering crossover in FIG. 12 with different channel CFs and the same channel BWs.

FIG. 16 illustrates synthesized and simulated near-band frequency responses of the third-order SIW filtering crossover in FIG. 12 with different channel CFs and the same channel BWs, where frequency (GHz) is presented along the x-axis and S-Parameters (dB) along on the y-axis. In this subsection, the third-order crossover system 1200 is synthesized with Chebyshev responses and 20-dB RLs for the two channels centered at $f_1$=12 GHz and $f_2$=13.5 GHz with the same BWs of 600 MHz ($\Delta_1$=5%, $\Delta_2$=4.44%). Thus, the normalized coupling matrix is the same as (3) for both channel passbands, and the physical dimensions of the over-mode dual-mode SIRC R2 can be figured out with equation (1). Dimensions (mm) are: d=0.6, p=1, $w_{ms}$=1.55, $w_{io}$=4.1, $w_1$=$l_1$=9.98, $w_2$=13.82, $l_2$=16.65, $w_3$=$l_3$=8.89, $w_{c12I}$=4.85, $w_{c12II}$=4.3, $w_{s1}$=$w_{s2}$=0.8, $l_{s1}$=1.59, $l_{s2}$=1.04, $t_1$=0.62, $t_2$=0.55. Substrate is a Rogers RT/Duriod 6002 substrate with h=0.508 mm.

FIG. 16 shows the simulated near-band frequency responses as well as the synthesized coupling matrix responses with average $Q_u$=300, which could be observed in a good agreement. The simulated minimum ILs in the two channel passbands are 0.83 and 0.97 dB with RLs better than 20 dB, while the simulated ripple-BWs are 600 and 620 MHz ($\Delta_1$=5%, $\Delta_2$=4.59%) with 3-dB BWs of 910 and 930 MHz, and the channel isolation is better than 29.2 dB across the passbands. As can be seen, the isolation is much better than that of the example in FIG. 15 with similar coupling window widths, which is mostly due to the weaker couplings between the two orthogonal modes with different frequencies.

Figures 17A, 17B:
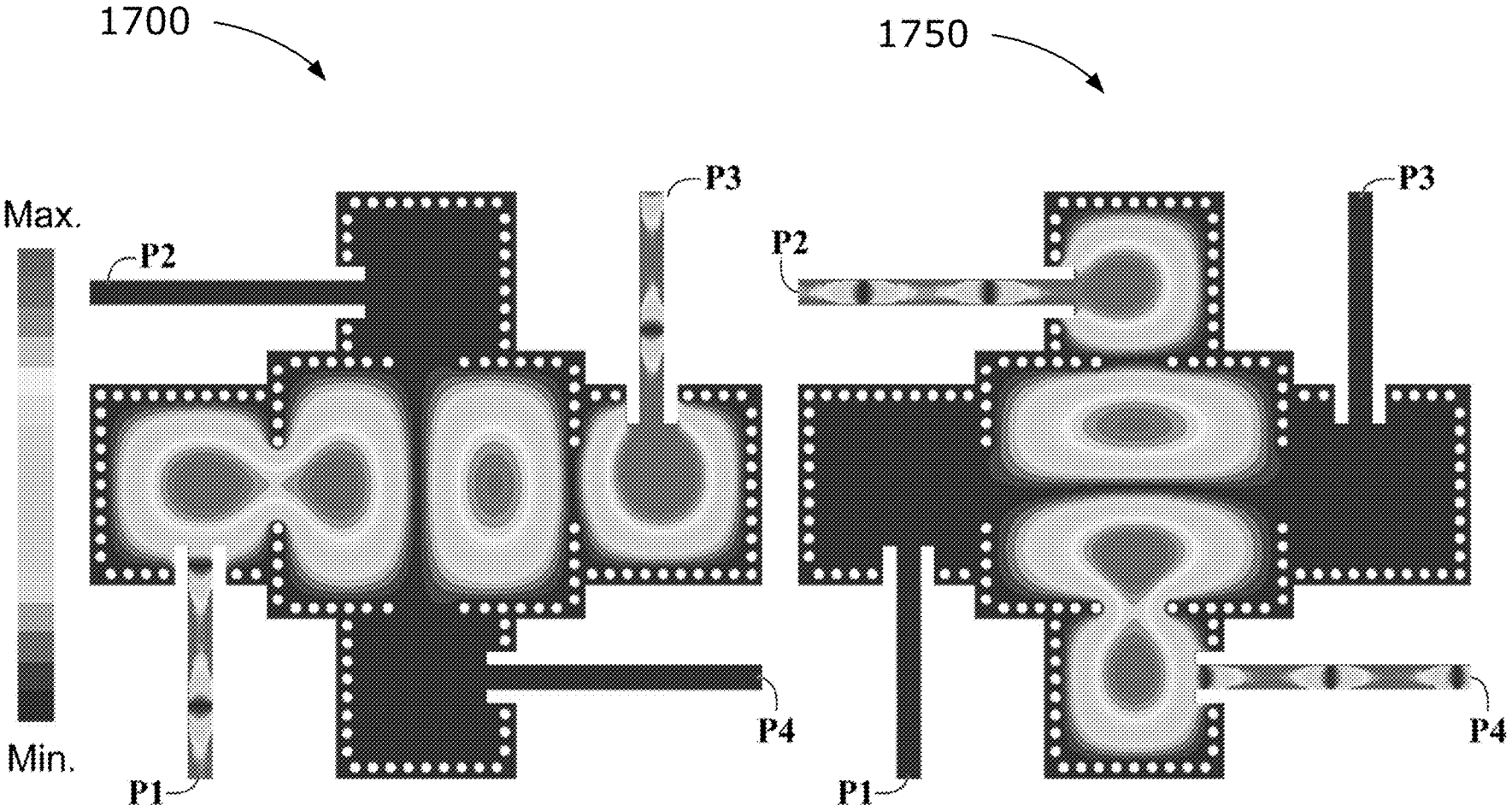
FIG. 17A illustrates electric field magnitude distributions of the two intersecting channels for the third-order SIW filtering crossover in FIG. 12 with different channel CFs and the same channel BWs with excitation of port P1.
FIG. 17B illustrates electric field magnitude distributions of the two intersecting channels for the third-order SIW filtering crossover in FIG. 12 with different channel CFs and the same channel BWs with excitation of port P2.

FIG. 17A illustrates electric field magnitude distributions 1700 of the two intersecting channels for the third-order SIW filtering crossover system 1200 in FIG. 12 with different channel CFs and the same channel BWs with excitation of port P1. FIG. 17B illustrates electric field magnitude distributions 1750 of the two intersecting channels for the third-order SIW filtering crossover system 1200 in FIG. 12 with different channel CFs and the same channel BWs with excitation of port P2.

Figure 18:
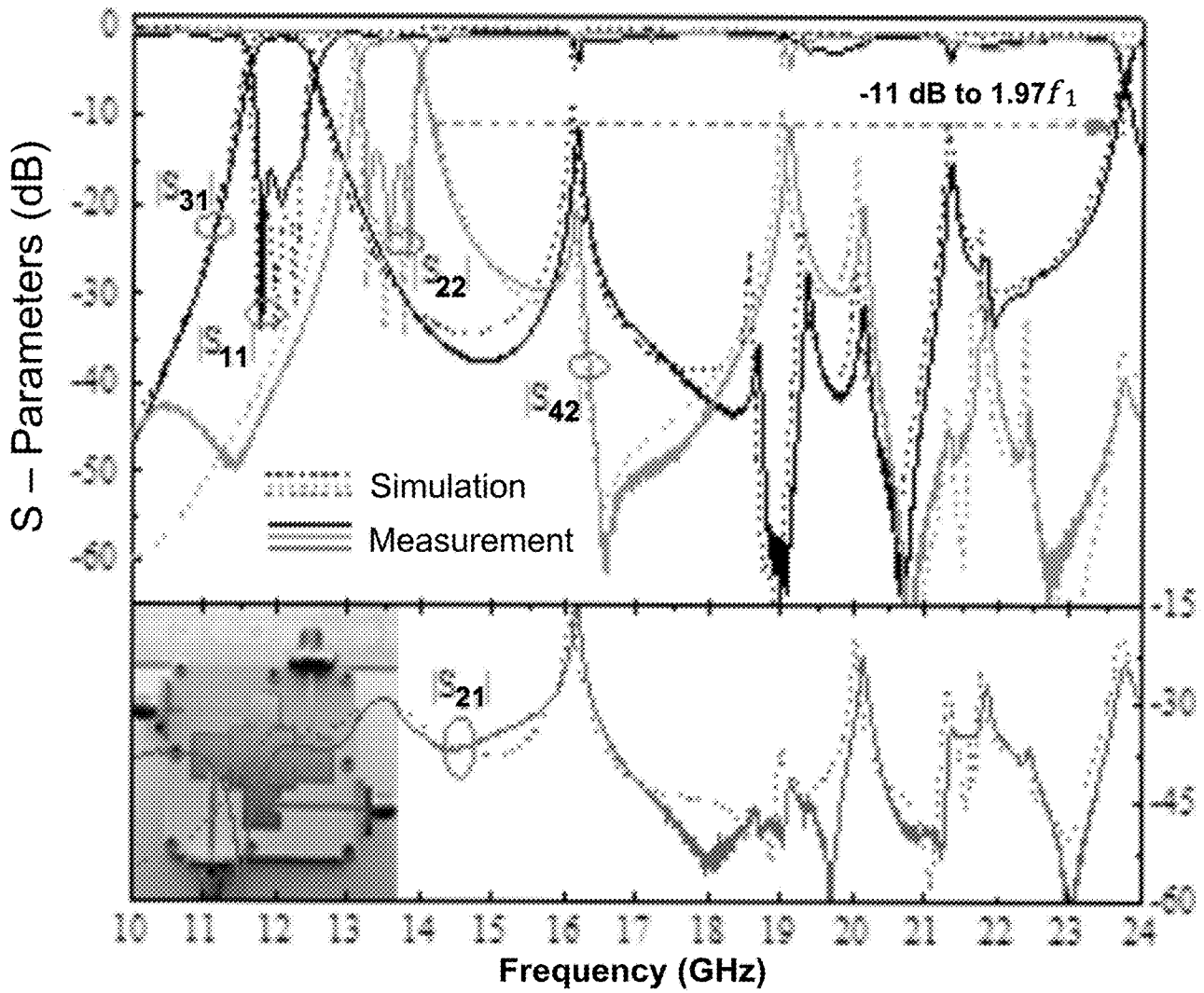
FIG. 18 shows a comparison between measured and simulated wideband frequency responses of the third-order SIW filtering crossover in FIG. 12.

FIG. 18 shows a comparison between measured and simulated wideband frequency responses of the third-order SIW filtering crossover system 1200 in FIG. 12, where frequency (GHz) is presented along the x-axis and S-Parameters (dB) along on the y-axis, and in which the inset is the photograph of the fabricated prototype with overall circuit size of 36.7 mm×31.7 mm ($2.52\lambda_g$×$2.17\lambda_g$). The measured ILs in the two passbands are 1.23 and 1.42 dB with RLs better than 16.2 and 14.0 dB, while the measured 3-dB BWs are 830 and 820 MHz with isolation better than 29 dB within the passbands. Additionally, the stopband is extended to $1.97f_1$ with a suppression level better than 11 dB, and the isolation is always better than 15 dB across the whole wideband. The frequency distributions of the first couple of leading resonant modes in constitutive cavities of this crossover are provided in FIG. 19 below, in which the higher-order resonances can be observed irregularly distributed on frequency spectrum up to 24 GHz.

Figure 19:
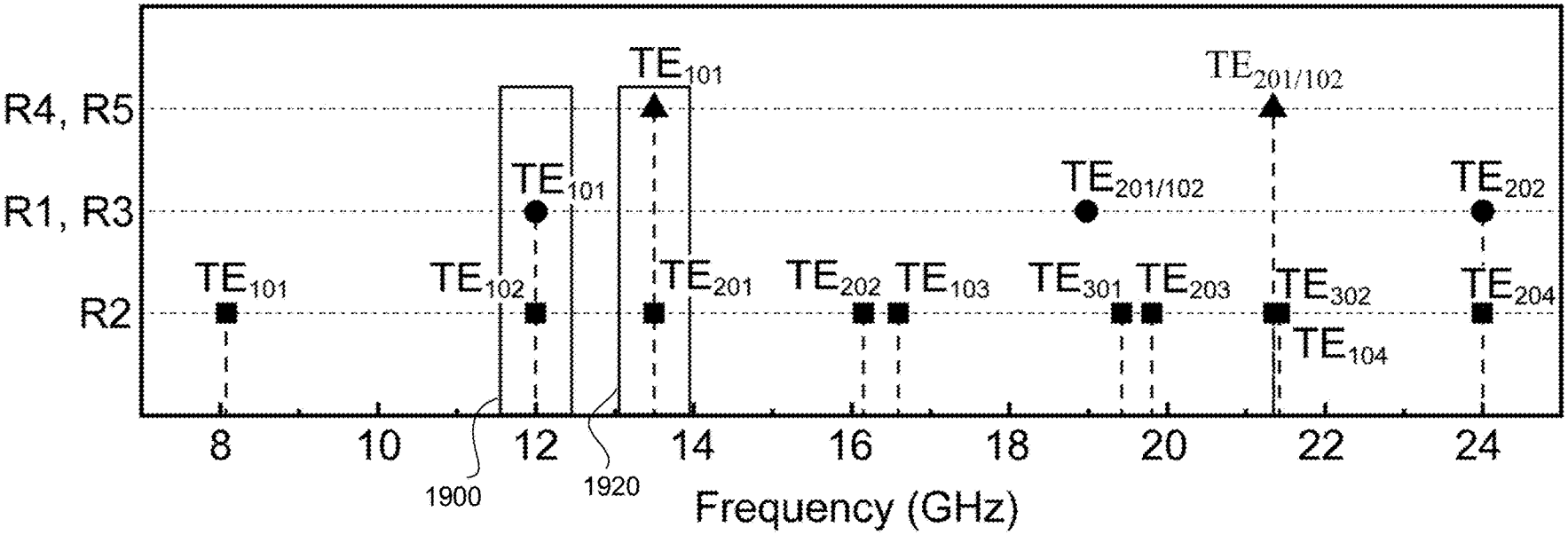
FIG. 19 shows frequency distributions of the leading resonant modes in constitutive cavities of the third-order SIW filtering crossover in FIG. 12.

FIG. 19 shows frequency distributions of the leading resonant modes in constitutive cavities of the third-order SIW filtering crossover in FIG. 12, with different channel CFs and the same channel BWs, where frequency (GHz) is presented along the x-axis and the SIRC along on the y-axis. Boxes 1900 and 1920 indicate the positions of the two channel passbands.

Some comparisons of the proposed SIW filtering crossover systems with other reported state-of-the-art demonstrations are listed in Table 1. Ref. [1] references the document T. Djerafi and K. Wu, "60 *GHz substrate integrated waveguide crossover structure*," in Proc. 39th Eur. Microwave Conf., Rome, Italy, October 2009, pp. 1014-1017, the content of which is herein incorporated by reference in its entirety. Ref. [2] references the document L. Han, K. Wu, X.-P. Chen, and F. He, "*Accurate analysis of finite periodic substrate integrated waveguide structures and its applications*," in IEEE MTT-S Int. Microw. Symp. Dig., Anaheim, Calif., USA, May 2010, pp. 864-867, the content of which is herein incorporated by reference in its entirety. Ref. [3] references the document A. B. Guntupalli, T. Djerafi, and K. Wu, "*Ultra-compact millimeter-wave substrate integrated waveguide crossover structure utilizing simultaneous electric and magnetic coupling*," in IEEE MTT-S Int. Microw. Symp. Dig., Montreal, QC, Canada, June 2012, pp. 1-3, the content of which is herein incorporated by reference in its entirety. Ref. [4] references the document X. F. Ye, S. Y. Zheng, and J. H. Deng, "*A compact patch crossover for millimeter-wave applications*," in Proc. IEEE Int. Workshop Electromagn. (iWEM), Hsinchu, Taiwan, November 2015, pp. 1-2, the content of which is herein incorporated by reference in its entirety. Ref. [5] references the document S. Y. Zheng and X. F. Ye, "*Ultra-compact wideband millimeter-wave crossover using slotted SIW structure*," in Proc. IEEE Int. Workshop Electromagn. (iWEM), Nanjing, China, May 2016, pp. 1-2, the content of which is herein incorporated by reference in its entirety. Ref. [6] references the document M. M. M. Ali and A. Sebak, "*Compact printed ridge gap waveguide crossover for future 5G wireless communication system*," IEEE Microw. Wireless Compon. Lett., vol. 28, no. 7, pp. 549-551, July 2018, the content of which is herein incorporated by reference in its entirety. Ref. [7] references the document S.-Q. Han, K. Zhou, J.-D. Zhang, C.-X. Zhou, and W. Wu, "*Novel substrate integrated waveguide filtering crossover using orthogonal degenerate modes*," IEEE Microw. Wireless Compon. Lett., vol. 27, no. 9, pp. 803-805, September 2017, the content of which is herein incorporated by reference in its entirety. Ref. [8] references the document S. S. Hesari and J. Bornemann, "*Substrate integrated waveguide crossover formed by orthogonal TE*102 *resonators*," in Proc. 47th Eur. Microw. Conf., Nuremberg, Germany, October 2017, pp. 17-20, the content of which is herein incorporated by reference in its entirety. Ref. [9] references the document Y. Zhou, K. Zhou, J. Zhang, C. Zhou, and W. Wu, "*Miniaturized substrate integrated waveguide filtering crossover*," in Proc. IEEE Elect. Design Adv. Packag. Syst. Symp. (EDAPS), Haining, China, December 2017, pp. 1-3, the content of which is herein incorporated by reference in its entirety. Ref. 10 references the document Y. Zhou, K. Zhou, J. Zhang, and W. Wu, "*Substrate-integrated waveguide filtering crossovers with improved selectivity*," Int. J. RF Microw. Comput.-Aided Eng. doi: 10.1002/mmce.22067, the content of which is herein incorporated by reference in its entirety.

Compared with the solutions in references [1]-[6], filtering functions are integrated in the crossover systems described in the example embodiments above. Compared to the designs in references [7]-[10] with identical frequency responses for the two channels, flexibly allocated channel CFs and BWs are implemented in the crossover systems described in the example embodiments above. Additionally, wide-stopband performances with excellent suppressions have been achieved in the crossover systems described in the example embodiments above, especially for the fifth-order design example.

Figure 20:
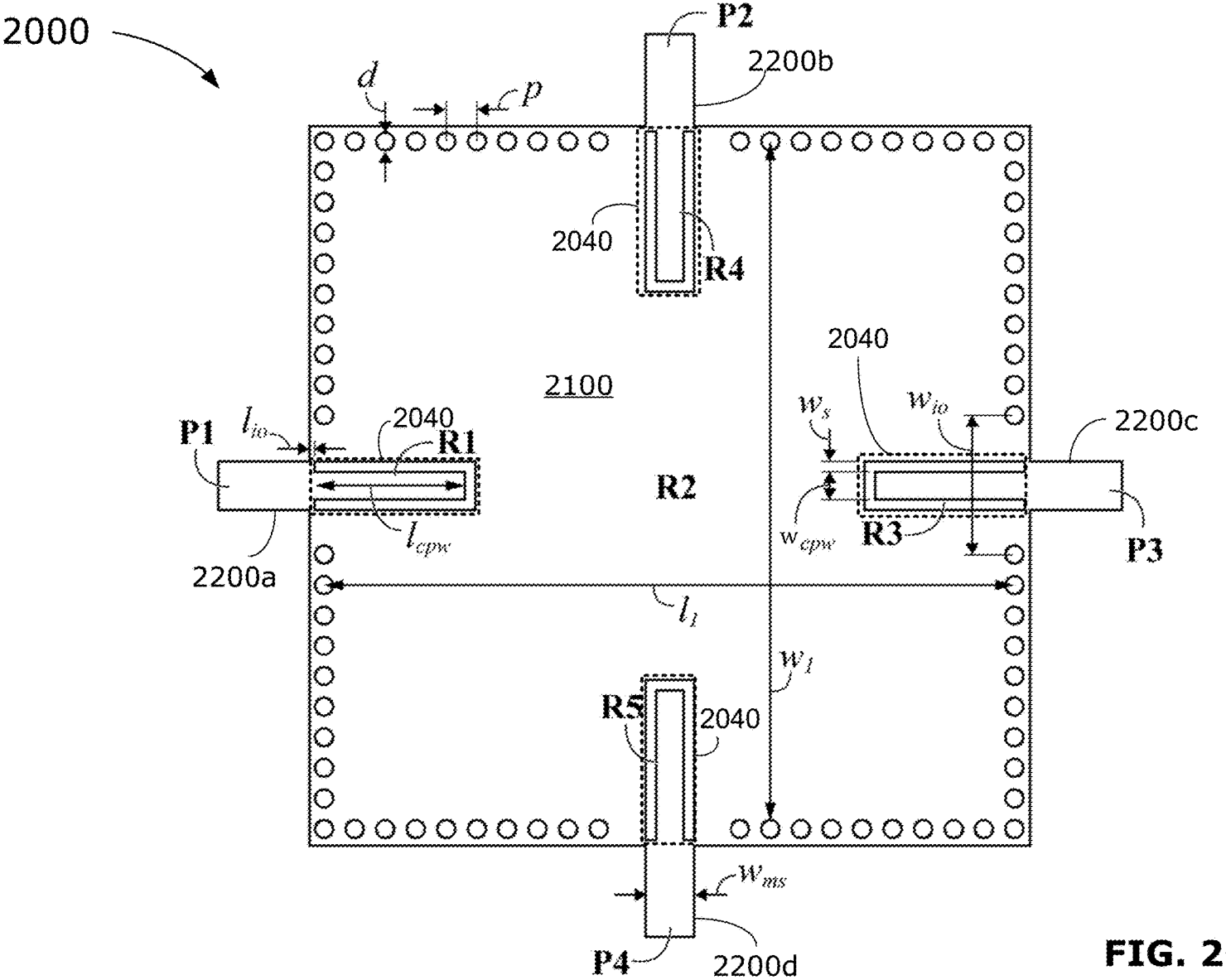
FIG. 20 illustrates an example configuration of another example third-order SIW filtering crossover, in accordance with some example embodiments.

FIG. 20 illustrates an example configuration of another example third-order SIW filtering crossover system 2000, in accordance with some example embodiments, where a dual-mode SIW square cavity R2 2100 operates with its $TE_{201}$ and $TE_{102}$ mode resonances while the embedded four CPW quarter-wavelength resonators 2040 (e.g. R1, R3, R4, and R5) coupled at its central symmetrical plane to achieve the isolation operate with the fundamental mode resonances. For example, each CPW resonator 2040 may be embedded or otherwise coupled to the center of a respective side of the dual-mode SIW square cavity. In this instance, the CPW resonators 2040 may be fabricated on top of the dielectric substrate of the dual-mode SIW square cavity R2 2100.

Since the layout is completely symmetrical about the cavity center, two identical transmission channels can be constructed by R1-R2-R3 and R4-R2-R5 with the same third-order filtering responses.

To excite the crossover system 2000, four 50-Ω microstrip lines 2200*a*, 2200*b*, 2200*c*, 2200*d* are connected to the cavity along its central symmetrical plane A-A' and B-B'. A microstrip 2200*a*, 2200*b*, 2200*c*, 2200*d* is a transmission line that has a conductor fabricated on the dielectric substrate of the SIRC 2100 with a grounded plane. Each of the microstrip lines 2200*a*, 2200*b*, 2200*c*, 2200*d* may include a conductor having a conductor width $W_{ms}$. Each of the microstrip lines 2200*a*, 2200*b*, 2200*c*, 2200*d* may have a port for receiving or exiting signals. For example, microstrip 2200*a* may have a port 1 indicated by P1, microstrip 2200*b* may have a port 2 indicated by P2, microstrip 2200*c* may have a port 3 indicated by P3 and microstrip 2200*d* may have a port 4 indicated by P4.

The external couplings between source (S) and R1, R3, where S denotes the input port of a transmission path (e.g. P1, P2) and load (L), where L denotes the output port of a transmission path (e.g. P3, P4) are basically controlled by their distance $l_{io}$, while the internal direct-couplings between R1 and R2, R2 and R3 are mainly dominated by the CPW resonator width $W_{cpw}$ and the slot width $W_s$, and the cross-couplings between S and R2, R2 and L are determined by coupling window width $W_{io}$.

TABLE 1

Comparisons with other reported SIW crossovers

| Ref. | CF (GHz) | FBW 3-dB (%) | IL (dB) | RL (dB) | Isolation (dB) | Filtering | Rej. (dB)/ S.B. | Size ($\lambda_g^2$) |
|---|---|---|---|---|---|---|---|---|
| [1] | 60 | 5 | 0.5 | 13 | 20 | X | x | 1.40 |
| [2] | 15 | 13.3 | 1.9 | 15 | 15 | X | x | 8.21 |
| [3] | 35 | 16.6 | 0.9 | 17 | 17 | X | x | 17.8 |
| [4] | 30 | 2.4 | 0.7 | 13 | 17 | X | x | 1.44 |
| [5] | 30 | 16.7 | 2 | 14 | 18 | X | x | 1.44 |
| [6] | 30 | 13.33 | 0.5 | 13 | 15 | X | x | 2.25 |
| [7] | 20 | 2.41 | 1.63 | 21 | 30 | ✓ | x | 6.29 |
| [8] | 24.75 | 12.12 | 1.1 | 17 | 12 | ✓ | x | 2.56 |
| | 25.4 | 3.27 | N/A | 10 | 23 | ✓ | x | 3.24 |
| | 23.85 | 2.31 | N/A | 20 | 24 | ✓ | x | 2.62 |
| [9] | 20 | 6.55 | 0.83 | 18.8 | 20 | ✓ | x | 4.06 |
| [10] | 20 | 6.6 | 1.05 | 18.5 | 20 | ✓ | x | 4.10 |
| | 20 | 1.9 | 2.2 | 18.0 | 27.5 | ✓ | x | 6.15 |
| System 700 | 12 | 7.17 | 1.41 | 18.5 | 21.8 | ✓ | $40/2.03f_1$ | 6.35 |
| System 1200-FIG. 15 | 12/12 | 7.92/5.17 | 1.26/1.65 | 15.9/17.9 | 21.9 | ✓ | $20/1.83f_1$ | 6.15 |
| System 1200-FIG. 18 | 12/13.5 | 6.92/6.07 | 1.23/1.42 | 16.2/14.0 | 29.0 | ✓ | $11/1.97f_1$ | 5.47 |

Rej. (dB)/S.B.: Rejection (dB)/Stopband, N/A: Not Applicable.

This third-order SIW filtering crossover can be synthesized with a quasi-elliptic filtering response and 20-dB return loss (RL) in the passband centered at $f_0$=10 GHz with the ripple-FBW Δ=4.05%, and the two finite transmission zeros (TZs) are designated at $\Omega_1$=+5.49 and $\Omega_2$=+7.07. The corresponding normalized coupling matrix [m] can be obtained as equation (4) below with an optimization algorithm in [11]. Ref. [11] references document S. Amari, "*Synthesis of cross-coupled resonator filters using an analytical gradient-based optimization technique*," IEEE Trans. Microw. Theory Techn., vol. 48, no. 9, pp. 1559-1564, September 2000, the content of which is herein incorporated by reference in its entirety. Subsequently, the design parameters could be calculated via (5) described in [12] as $f_{01}=f_{03}$=10.058 GHz, $f_{02}$=9.940, $M_{12}=M_{23}$=0.0421, $M_{13}$=0.00011, $Q_{S1}=Q_{3L}$=21.64, $Q_{S2}=Q_{2L}$=686.9. Ref. [12] references document J.-S. Hong and M. J. Lancaster, Microstrip Filters for RF/Microwave Applications. New York, N.Y., USA: Wiley, 2001, chs. 8-10, the content of which is herein incorporated by reference in its entirety.

$$S[m] = \begin{array}{c} \\ S \\ 1 \\ 2 \\ 3 \\ L \end{array} \begin{array}{c} \begin{array}{ccccc} S & 1 & 2 & 3 & L \end{array} \\ \begin{bmatrix} 0 & 1.0682 & 0.1896 & 0 & 0 \\ 1.0682 & -0.287 & 1.0395 & 0.0027 & 0 \\ 0.1896 & 1.0395 & 0.2965 & 1.0395 & 0.1896 \\ 0 & 0.0027 & 1.0395 & -0.287 & 1.0682 \\ 0 & 0 & 0.1896 & 1.0682 & 0 \end{bmatrix} \end{array} \tag{4}$$

$$\begin{cases} f_{0i} = f_0 \cdot (1 - m_{ii} \cdot \Delta/2) \\ Q_{s1} = 1/(m_{S1}^2 \cdot \Delta),\ Q_{3L} = 1/(m_{3L}^2 \cdot \Delta) \\ Q_{s2} = 1/(m_{S2}^2 \cdot \Delta),\ Q_{2L} = 1/(m_{2L}^2 \cdot \Delta) \\ M_{ij} = m_{ij} \cdot \Delta,\ i,\ j \in [1, 2, 3]. \end{cases} \tag{5}$$

In some embodiments, the system 2000 can be fabricated on a Rogers RT/Duriod 5880 substrate with the relative dielectric constant $\varepsilon_r$=2.2, loss tangent tan δ=0.0009, and thickness h=0.508 mm. The diameter of the metalized via-holes of SIW can be selected as d=0.6 mm, and the pitch as p=1 mm. The preliminary dimensions of the SIW square cavity can be calculated with $f_{TE201}=f_{TE102}=f_{02}$=9.94 GHz as $w_1=l_1$=23.13 mm, and the physical sizes of the CPW resonators operating with $f_{01}=f_{03}$=10.058 GHz are obtained as $l_{cpw}$=4.96 mm, $w_{cpw}$=0.9 mm, $w_s$=0.3 mm. The design curves of the design parameters can then be extracted by using the methods presented in [12] on the basis of these dimensional parameters.

Figure 21:
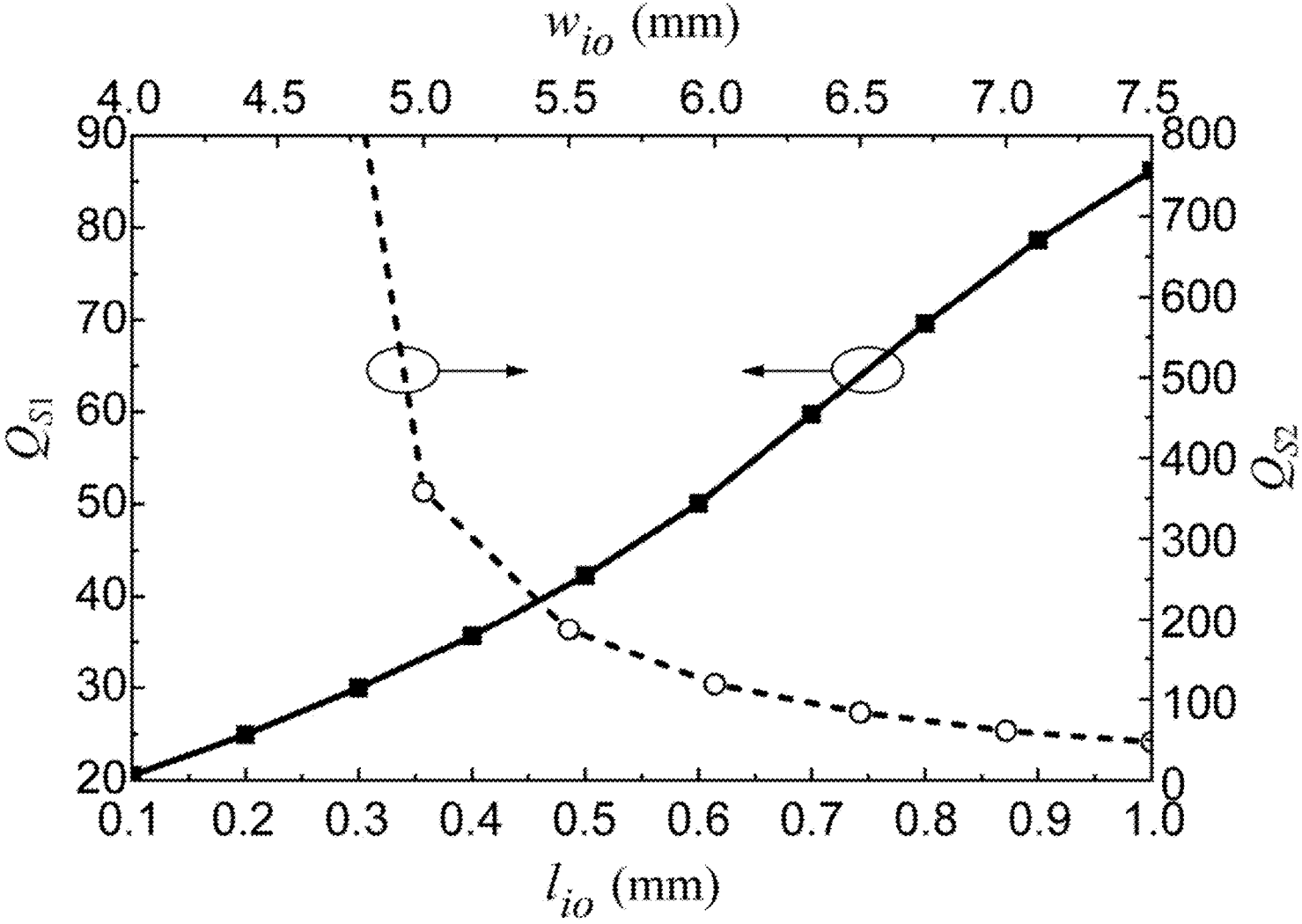
FIG. 21 illustrates a set of example design curves for the third-order SIW filtering crossover in FIG. 20.

FIG. 21 illustrates a set of example design curves for the third-order SIW filtering crossover system 2000 in FIG. 20, with design curves $Q_{S1}$ against $l_{io}$ in mm and $Q_{S2}$ against $w_{io}$ in mm. Dimensions of other parameters in the extraction (mm) are: $w_{ms}$=1.55, $w_{cpw}$=0.9, $w_s$=0.3, $l_{cp}$w=4.96, $w_1=l_1$=23.13. It can be observed that consistent with the coupling characteristics, $Q_{s1}$ increases almost linearly with the increase of $l_{io}$, while $Q_{s2}$ decreases monotonically against $w_{io}$. Consequently, the coupling parameters corresponding to the design parameters can be roughly estimated as $l_{io}$=0.15 mm and $w_{io}$=4.8 mm based on $Q_{s1}$=21.64 and $Q_{s2}$=686.9.

Figure 22:
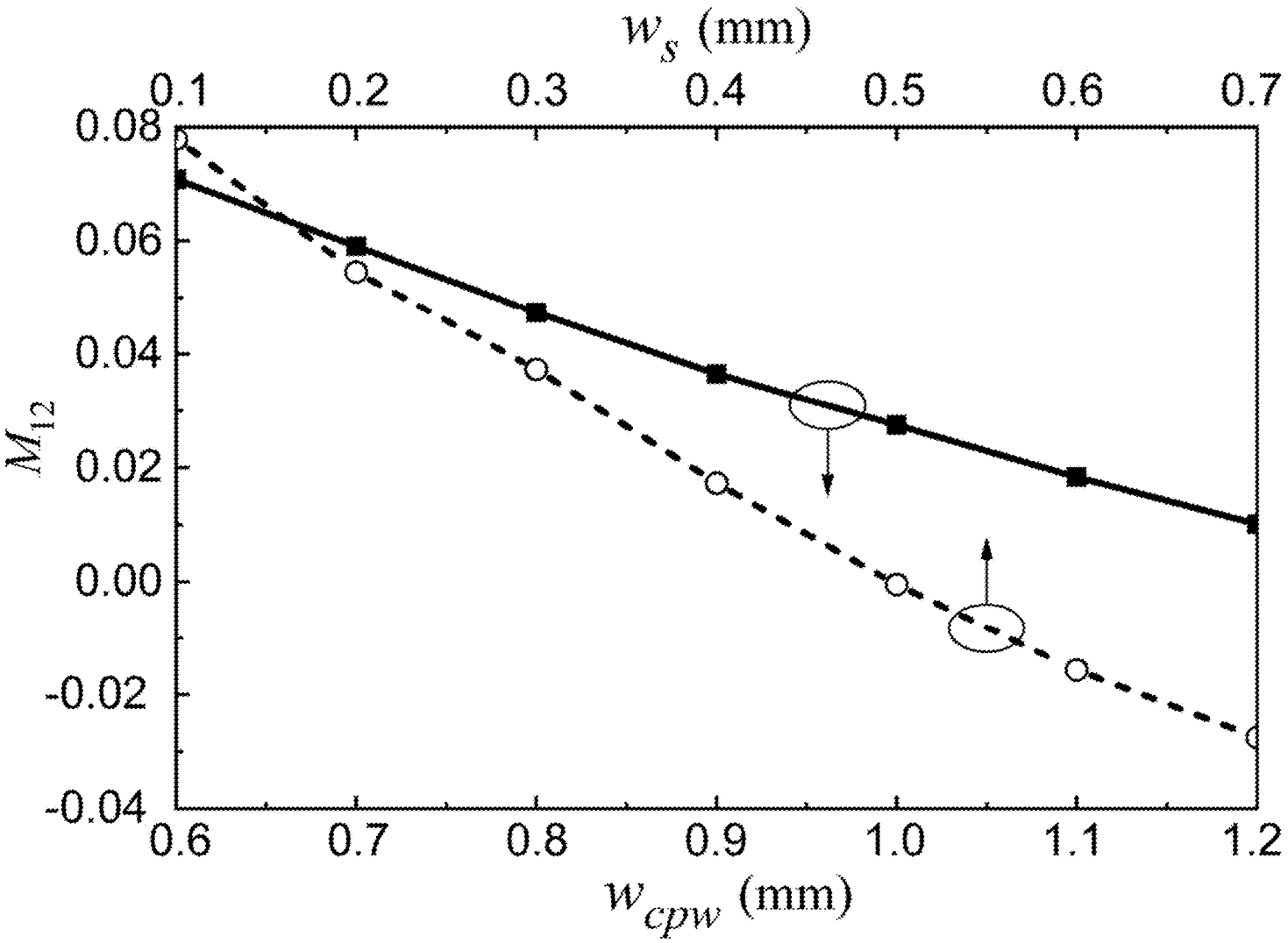
FIG. 22 illustrates another set of example design curves for the third-order SIW filtering crossover in FIG. 20.

FIG. 22 illustrates another set of example design curves for the third-order SIW filtering crossover in FIG. 20, with design curves of $M_{12}$ versus the CPW resonator width $w_{cpw}$ in mm and the slot width $w_s$ in mm. As can be seen, $M_{12}$ decreases monotonically with increasing $w_{cpw}$ and $w_s$. The coupling nature of $M_{12}$ may become electric from magnetic when $w_{cpw}$>1.3 and $w_s$>1. Therefore, if only the magnetic coupling is required, the CPW resonator width and slot width must meet the conditions that $w_{cpw}$<1.3 and $w_s$<1, and the coupling parameters here can be roughly determined as $w_{cpw}$=0.88 mm and $w_s$=0.27 mm.

It should be pointed out that except the above coupling parameters, the external and internal couplings in this structure may also be influenced by other inter-inhibitive parameters. For example, $Q_{s1}$ may be determined by $w_{io}$, $w_{cpw}$, and $w_s$ except the parameter $l_{io}$, while $Q_{s2}$ may be affected by the CPW resonators as well. $M_{12}$ may be impacted by $w_{io}$ and $l_{io}$ while the coupling parameters $w_{cpw}$ and $w_s$ may have an impact on the resonant frequencies of CPW resonators.

Additionally, the coupling coefficient $M_{13}$ might not be controlled in this case due to lacking controlling parameters. Consequently, the extracted curves in FIGS. 21 and 22 are only coarse design curves, and a fine tuning procedure using the full-wave simulation tool ANSYS HFSS may be carried out to obtain more accurate results after determining all of the preliminary dimensions.

Figure 23:
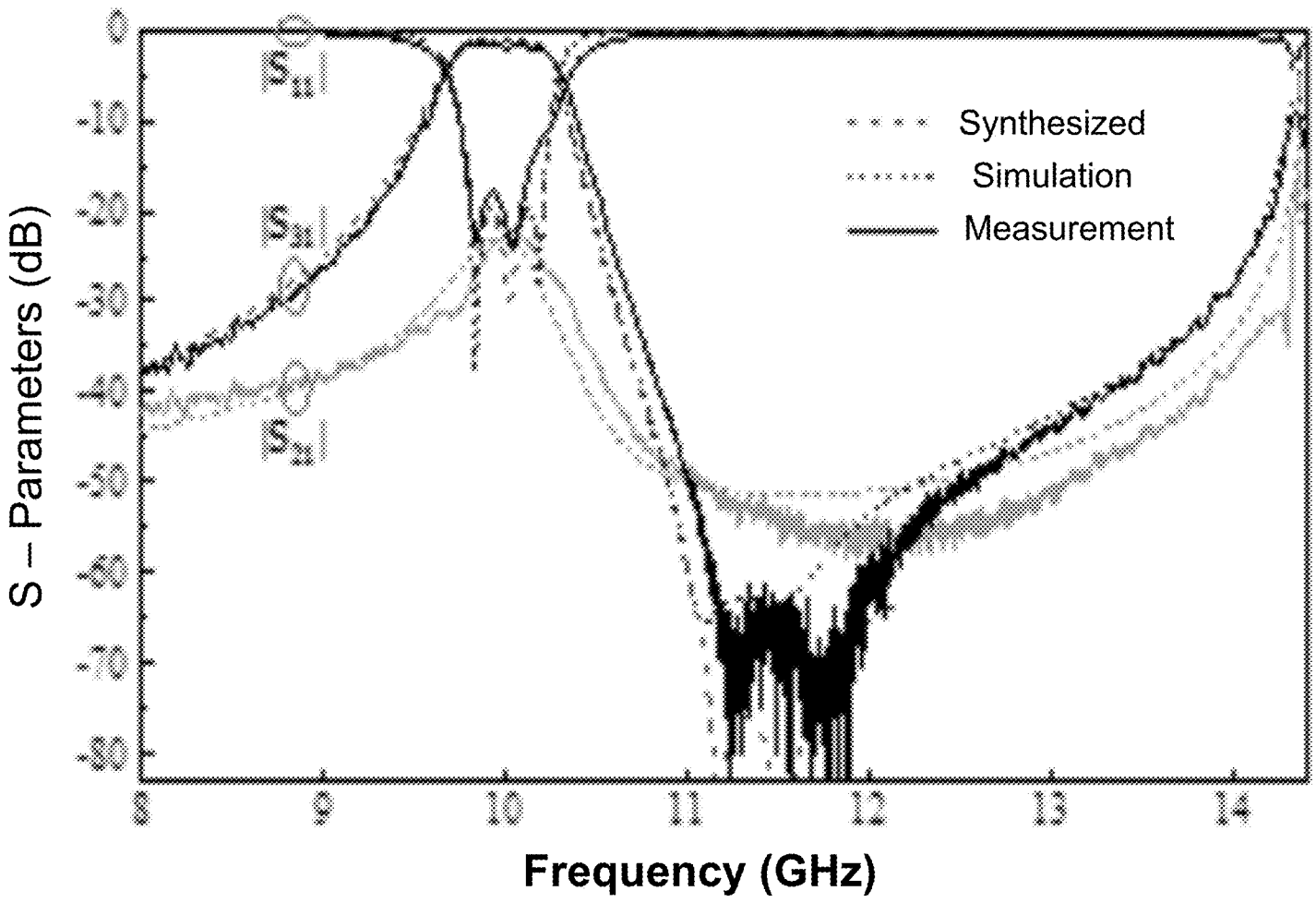
FIG. 23 illustrates synthesized, simulated, and measured responses of the example third-order SIW filtering crossover in FIG. 20.

FIG. 23 illustrates synthesized, simulated, and measured responses of the example third-order SIW filtering crossover in FIG. 20, where frequency (GHz) is presented along the x-axis and S-Parameters (dB) along on the y-axis. Dimensions in mm are: d=0.6, p=1, $w_{ms}$=1.55, $w_{io}$=4.6, $l_{io}$=0.2, $w_{cpw}$=0.91, $l_{cpw}$=4.89, $w_s$=0.3, $w_1=l_1$=22.59. The overall circuit size of the crossover system 2000 is 23.6 mm×23.6 mm (1.17$\lambda_g$×1.17$\lambda_g$), where $\lambda_g=c/f_0/\varepsilon_r^{1/2}$ is the guided wavelength in the dielectric substrate at $f_0$. Measurements have been carried out with an Agilent N5244A network analyzer, and FIG. 23 shows the comparison between the measured and simulated results as well as the synthesized coupling matrix responses with average unloaded quality factor $Q_u$=230. Excellent agreement can be observed among the synthesized, simulated, and measured responses except a little discrepancy around the finite transmission zeros (TZs), which is basically attributed to the error of the weak cross-couplings.

Taking into account all the losses including the conductor, dielectric, and radiation losses, the simulated minimum IL is 1.27 dB with RL better than 19.7 dB in the passband while the measured IL is 1.63 dB and RL better than 13 dB. The simulated ripple-bandwidth is 406 MHz (Δ=4.06%) with 3-dB bandwidth of 593 MHz, while the measured 3-dB bandwidth is 615 MHz. Additionally, the measured channel isolation is better than 22.5 dB over the interested band.

Figure 24B:
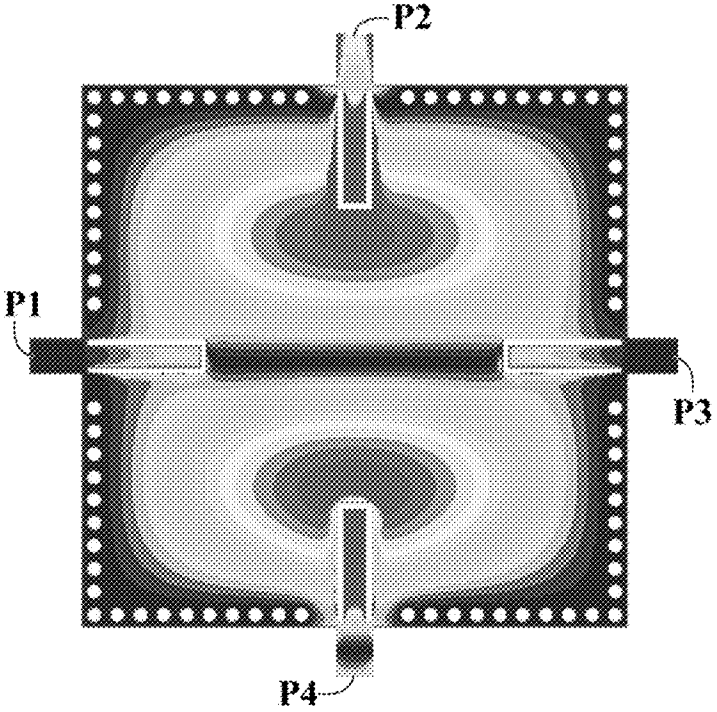
FIG. 24B illustrates electric filed magnitude distributions of two intersecting channels of the example third-order SIW filtering crossover in FIG. 20 with excitation of port P2.
Figure 24A:
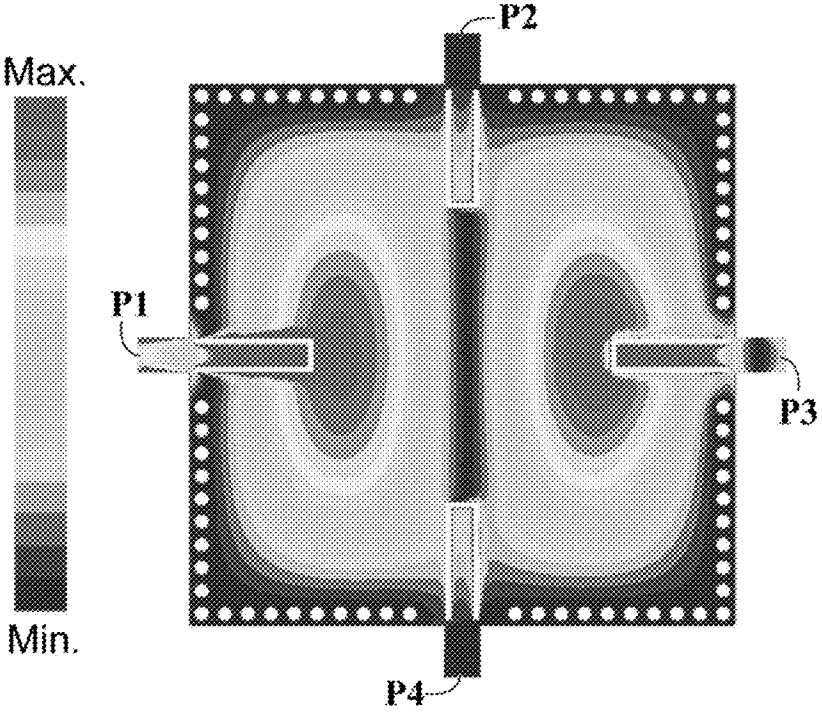
FIG. 24A illustrates electric filed magnitude distributions of two intersecting channels of the example third-order SIW filtering crossover in FIG. 20 with excitation of port P1.

FIG. 24A illustrates electric filed magnitude distributions 2400 of two intersecting channels of the example third-order SIW filtering crossover in FIG. 20 with excitation of port P1. FIG. 24B illustrates electric filed magnitude distributions 2450 of two crossing channels of the example third-order SIW filtering crossover in FIG. 20 with excitation of port P2. It can clearly be seen that the horizontal channel is dominated by the fundamental modes of R1, R2, and $TE_{102}$ mode of cavity R3, while the vertical channel is constructed by fundamental modes of R4, R5, and $TE_{201}$ mode of R3. Additionally, almost no energy can be observed to be transmitted to another channel when one channel is excited, leading to the acceptable channel isolation.

Table 2 lists the comparisons of the SIW filtering crossover system 2000 in FIG. 20 with other reported state-of-the-art designs. Compared with the works in references [1]-[6], filtering function has been integrated in the SIW filtering crossover system 2000 with flexibly allocated bandwidth. Additionally, benefitting from the usage of only one over-mode SIW cavity and the embedded scheme of CPW resonators, the smallest footprint has been achieved to date compared to the other designs, including those SIW filtering crossovers in references [7]-[9].

TABLE 2

Comparisons with other reported SIW crossovers.

| Ref. | $f_0$ (GHz) | FBW 3-dB (%) | IL (dB) | RL (dB) | Isolation (dB) | Filtering | Size ($\lambda_g^2$) |
|---|---|---|---|---|---|---|---|
| [1] | 60 | 5 | 0.5 | 13 | 20 | x | 1.40 |
| [2] | 15 | 13.3 | 1.9 | 15 | 15 | x | 8.21 |
| [3] | 35 | 16.6 | 0.9 | 17 | 17 | x | 17.8 |
| [4] | 30 | 2.4 | 0.7 | 13 | 17 | x | 1.44 |
| [5] | 30 | 16.7 | 2 | 14 | 18 | x | 1.44 |
| [6] | 30 | 13.33 | 0.5 | 13 | 15 | x | 2.25 |
| [7] | 20 | 2.41 | 1.63 | 21 | 30 | ✓ | 6.29 |
| [8] | 24.75 | 12.12 | 1.1 | 17 | 12 | ✓ | 2.56 |
| | 25.4 | 3.27 | N/A | 10 | 23 | ✓ | 3.24 |
| | 23.85 | 2.31 | N/A | 20 | 24 | ✓ | 2.62 |
| [9] | 20 | 6.55 | 0.83 | 18.8 | 20 | ✓ | 4.06 |
| System 2000 | 10 | 6.15 | 1.63 | 13 | 22.5 | ✓ | 1.36 |

In some embodiments, the miniaturization of SIW filtering crossover is achieved by combining one over-mode SIW square cavity and four CPW quarter-wavelength resonators.

In some embodiments, the CFs and BWs of two intersecting channels can be allocated flexibly within wide ranges for the SIW filtering crossover systems, which could not be achieved with conventional schemes.

Wide-stopband characteristics have been implemented intrinsically and uniquely to avoid or reduce interferences of spurious signals from outside or inside the transceivers by incorporating three types of intrinsic spurious-mode suppression techniques including harmonic staggered method, centred coupling windows, and offset centred feeding ports, which are not present in conventional SIW crossovers.

The realizable frequency ratio of $TE_{102}$ and $TE_{201}$ modes in an SIRC would be in the range of [1, 1.17], where the range denotes a lower and upper bound of potential frequency ratios for $TE_{102}$ and $TE_{201}$ modes, if an acceptable frequency spacing must be met between the fourth and third resonances. An example of analysis of the realizable frequency ratio is described in the document K. Zhou, C.-X. Zhou, and W. Wu, "*Substrate-integrated waveguide dual-band filters with closely spaced passbands and flexibly allocated bandwidths,*" *IEEE Trans. Compon., Packag., Manuf. Technol.*, vol. 8, no. 3, pp. 465-472, March 2018, the content of which is herein incorporated by reference in its entirety. Since the higher-order resonances in the single-mode square cavities are much higher than the fourth resonance in the over-mode dual-mode SIRC as demonstrated in FIGS. 11 and 19, the above range is also correct for $f_2/f_1$ of the crossover systems contemplated by this disclosure. Moreover, since the channel BWs can be designated as any values only if the coupling window widths are specified within the maximum values to meet the isolation requirement, there is no practical limitations for $\Delta_2/\Delta_1$. Additionally, as the frequencies of $TE_{201}$ and $TE_{102}$ modes are more sensitive and dependent on respective $w_1$ and $l_1$ in FIG. 3, and the couplings of the two channels are almost non-interactive with each other, the CFs and BWs of the two channels can be allocated and tuned almost independently, which can be beneficial in the circuit design and tuning process.

As direct-coupled topologies can be implemented by the configurations presented here, thus only odd-order Chebyshev filtering responses are synthesized and mapped with symmetrical circuit structures. In some embodiments, even-order responses may also be implemented with asymmetrical circuit topologies, e.g., with two single-mode square cavities coupled on the left side of the over-mode dual-mode SIRC while one coupled on the right side to implement the fourth-order responses. Additionally, if more single-mode cavities are added, cross-coupled topologies may also be implemented to produce finite transmission zeros near the passbands to improve selectivity, and different orders may be achieved as well for the two channel passbands.

In some embodiments, higher-order filtering responses should be employed if larger BWs are needed. For current crossovers, the larger the BWs is designated, the worse the stopband might be. It can also be concluded from the fifth- and third-order filtering crossovers that the higher the order is, the better the stopband would become. The stopband would become better if the spurious resonances are better staggered in upper stopband.

Certain adaptations and modifications of the described embodiments can be made. Therefore, the above discussed embodiments are considered to be illustrative and not restrictive. Although this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

While the present disclosure has been illustrated by description of several embodiments and while the illustrative embodiments have been described in detail, it is not the intention of the applicant to restrict or in any way limit the scope of the claims to such detail. Additional advantages and modifications will readily appear to those skilled in the art. The invention in its broader aspects is therefore not limited to the specific details, representative devices and methods, and illustrative examples shown and described. Accordingly, departures may be made from such details without departing from the scope or spirit of the general inventive concept.

The invention claimed is:

1. A substrate-integrated waveguide (SIW) filtering crossover system, comprising:

a dual-mode substrate-integrated rectangular cavity (SIRC); and a plurality of single-mode SIW square cavities comprising eight single-mode SIW square cavities;

wherein two of the eight single-mode SIW square cavities are coupled to a respective side of the dual-mode SIRC.

2. The system of claim 1, further comprising a plurality of microstrip lines, wherein each of the plurality of microstrip lines is fabricated on a respective SIW square cavity from the plurality of single-mode SIW square cavities.

3. The system of claim 1, wherein the dual-mode SIRC operates with $TE_{102}$ and $TE_{201}$ mode resonances.

4. The system of claim 1, wherein a first transmission route is formed by the dual-mode SIRC and four of the eight single-mode SIW square cavities.

5. The system of claim 4, wherein a second transmission route is formed by the dual-mode SIRC and the remaining four of the eight single-mode SIW square cavities.

6. The system of claim 5, wherein an offset variable is configured for a port of the first or second transmission route to reject unwanted spurious resonant peaks of a received signal.

7. A substrate integrated waveguide (SIW) filtering crossover system comprising:

a substrate;

a top metal plate placed on top of the substrate;

a bottom metal plate placed beneath the substrate;

a plurality of metalized via-holes in the substrate connecting the top metal plate and the bottom metal plate, one or more rows of metalized via-holes in the plurality of metalized via-holes being centered around a center of the system to form a dual-mode substrate-integrated rectangular cavity (SIRC) at the center of the system and one or more rows of metalized via-holes in the plurality of metalized via-holes being positioned along the sidewalls of the system to form eight single-mode SIW square cavities, wherein two of the eight single-mode SIW square cavities are coupled to a respective side of the dual-mode SIRC; and a plurality of grounded-coplanar-waveguides (GCPWs) coupled to the top metal plate of the crossover system, wherein each of the GCPWs connects the crossover system to a respective microstrip line for signal transmission between the respective microstrip line and the crossover system.

8. The system of claim 7, further comprising one or more coupling windows on the sidewalls configured to control one or more internal couplings based on specified bandwidths.

9. The system of claim 8, further comprising one or more coupling windows, each arranged at a center position of a sidewall of one or more SIW cavities to suppress unwanted even-mode spurious resonant peaks in upper stopband of two channel filters.

10. The system of claim 8, further comprising one or more coupling windows, each arranged at a center position of a sidewall of the dual-mode SIRC to isolate two intersecting channels in the dual-mode SIRC.

11. The system of claim 7, wherein the dual-mode SIRC is a rectangular cavity configured to facilitate different frequencies of one or more channel filters within the system.

12. The system of claim 7, wherein the single-mode SIW square cavities are configured with different sizes to facilitate different frequencies of one or more channel filters within the system.

13. The system of claim 7, wherein the single-mode SIW square cavities are orthogonally arranged to suppress spurious peaks in upper stopband.

* * * * *